US008550832B2

(12) United States Patent
Regnier et al.

(10) Patent No.: US 8,550,832 B2
(45) Date of Patent: Oct. 8, 2013

(54) CONNECTOR WITH WIRE MODULE ACTUATED BY A CRIMP TAB

(75) Inventors: Kent E. Regnier, Lombard, IL (US); Johnny Chen, Danville, CA (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/320,624

(22) PCT Filed: May 14, 2010

(86) PCT No.: PCT/US2010/034855

§ 371 (c)(1), (2), (4) Date: Jan. 25, 2012

(87) PCT Pub. No.: WO2010/132739

PCT Pub. Date: Nov. 18, 2010

(65) Prior Publication Data

US 2012/0129382 A1 May 24, 2012

Related U.S. Application Data

(60) Provisional application No. 61/178,925, filed on May 15, 2010.

(51) Int. Cl.
*H01R 13/62* (2006.01)

(52) U.S. Cl.
USPC ..... 439/260

(58) Field of Classification Search
USPC ..... 439/260, 259, 342, 421, 431, 395, 404
See application file for complete search history.

(56) References Cited

U.S. PATENT DOCUMENTS

| | | | | |
|---|---|---|---|---|
| 5,038,005 | A * | 8/1991 | Hohorst et al. | 200/51.06 |
| 5,580,270 | A | 12/1996 | Pantland et al. | |
| 6,078,661 | A | 6/2000 | Arnett et al. | |
| 6,179,627 | B1 | 1/2001 | Daly et al. | |
| 6,229,890 | B1 | 5/2001 | Kerr et al. | |
| 7,909,639 | B2 * | 3/2011 | Hirata et al. | 439/495 |
| 7,946,872 | B2 * | 5/2011 | Taketomi et al. | 439/260 |
| 2002/0132529 | A1 | 9/2002 | Tharp et al. | |
| 2009/0221178 | A1 * | 9/2009 | Hirata et al. | 439/497 |
| 2010/0029119 | A1 * | 2/2010 | Taketomi et al. | 439/329 |

FOREIGN PATENT DOCUMENTS

EP 1 930 993 A1 6/2008

OTHER PUBLICATIONS

International Search Report for PCT/US2010/034855.

* cited by examiner

*Primary Examiner* — Chandrika Prasad
(74) *Attorney, Agent, or Firm* — Stephen L. Sheldon

(57) ABSTRACT

A plug connector is provided that can be electrically coupled to wires provided in a cable. The connector includes a leadframe that supports contacts and insulation displacement terminals in electrical communication. The connector includes a wire module that includes wire channels. A cage is provided to support the leadframe and the wire module. When wires from the cable are inserted into the wire channels, the wire module can be translated so that the insulation displacement terminals engage the wires. In an embodiment, the electrical path between a contact and a corresponding insulation displacement terminal can extend through magnetics and the magnetics can help increase the signal to noise ratio.

16 Claims, 25 Drawing Sheets

CONNECTOR WITH WIRE MODULE ACTUATED BY A CRIMP TAB

This application is a national phase of PCT Application No. PCT/US2010/034855, filed May 14, 2010, which in turn claims priority to U.S. Provisional Application No. 61/178,925, filed May 15, 2010, which is incorporated herein by reference in its entirety.

BACKGROUND OF THE INVENTION

1. Field of the Invention

The present invention relates to the field of connectors, more specifically to the field of high-speed connectors suitable for use in data transmission.

2. Description of Related Art

Connectors are commonly used to couple a communication circuit on a first circuit board to a communication circuit on a second circuit board. For example, a connectors system can include a plug and a receptacle, with the receptacle mounted to a circuit board and a plug mounted on an end of a cable.

As is known, increasing the distance that the signal needs to travel (e.g., using a longer cable) increases the difficulty of transmitting a signal. Signals become more attenuated as the cable lengths increase. In addition, higher frequencies tend to be attenuated more quickly in cables. Compounding this issue is the fact that greater lengths of cable tends to pick up more noise. As can be appreciated, therefore, decreasing the signal strength while increasing the signal noise will eventually make it so that the signal cannot be discerned over the signal noise. This natural occurrence acts to limit the length of cable that can be used.

To address the above issues, different communication protocols use different techniques to address the issue. Gigabit Ethernet, for example, which is intended to be run over twisted-pair, such as Category 5e or Category 6 cable, limits segment lengths to 100 meters and uses 5 level pulse amplitude modulation (PAM-5) to limit the need for high frequencies. 10GBASE-T (also referred to as IEEE 802.3an) also works over twisted pair but uses 16 level pulse amplitude modification (PAM-16) to achieve the higher data rates. Current connector designs appear to provide 55 meters with Category 6 cables and new cable (Category 6a) is being planned to allow the desired 100 meter segment lengths. The need to upgrade cable in order to provide 10GBASE-T, however, makes the upgrade path less desirable and therefore certain people would appreciate a design that could help enable 100 meter segments of 10GBASE-T over category 6 or even 5e cable. Further improvements would also benefit the system, potentially reducing the cost of transceiver circuitry.

BRIEF SUMMARY OF THE INVENTION

A connector is disclosed that is suitable for use with cables that include twisted pair wires. The connector includes a cage mounted at least partially around a housing. In an embodiment, a wire module is positioned in the housing and is configured to receive wires from the twisted pair cable. A leadframe that supports terminals is also positioned in the housing and the leadframe includes an insulation displacement feature. The cable module and leadframe are configured to be pressed together so that insulated conductive members from the twisted pair cable are mounted to the insulation displacement feature. The housing can be configured so that the connector is compatible with the receptacle designed for the commonly used IEC 60603-7 8P8C connector (commonly referred to as a RJ-45 connector). In an embodiment, magnetics can be positioned in the connector in an electrical path between the insulation displacement feature and the contact so as to provide improved signal to noise ratios.

BRIEF DESCRIPTION OF THE DRAWINGS

The present invention is illustrated by way of example and not limited in the accompanying figures in which like reference numerals indicate similar elements and in which:

FIG. 23*a* illustrates a schematic view of another embodiment of a cable assembly.

DETAILED DESCRIPTION OF THE INVENTION

Figure 1:
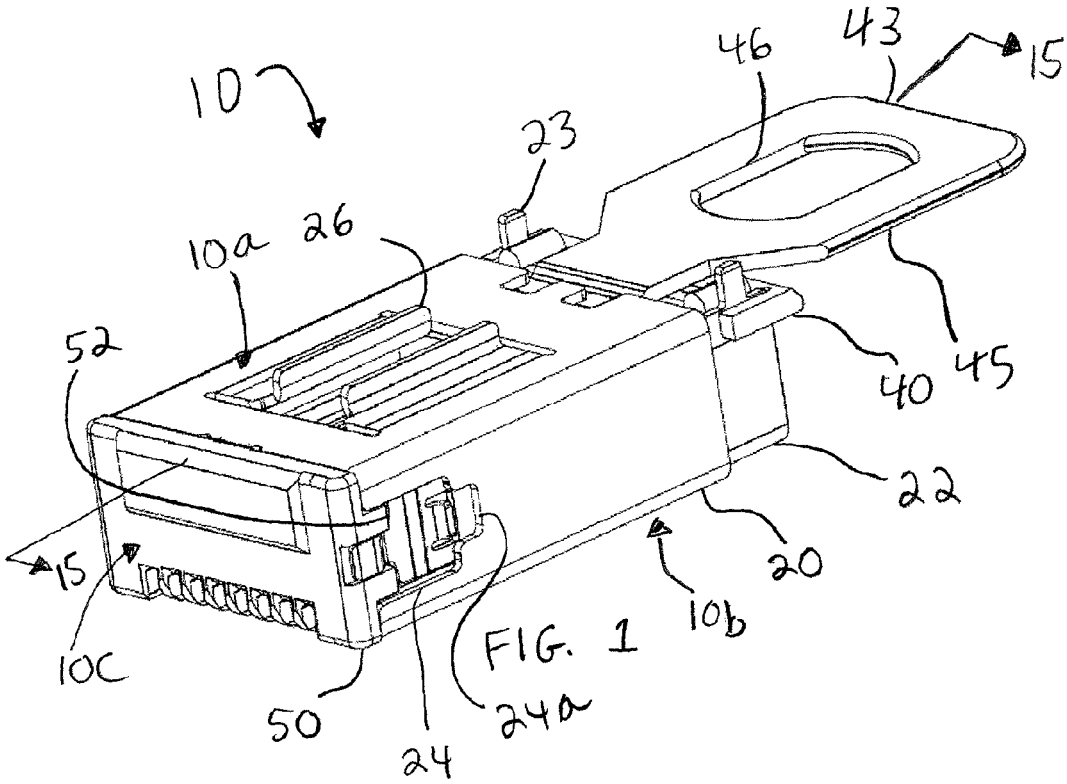
FIG. 1 illustrates a perspective view of an embodiment of a connector.
Figure 1A:
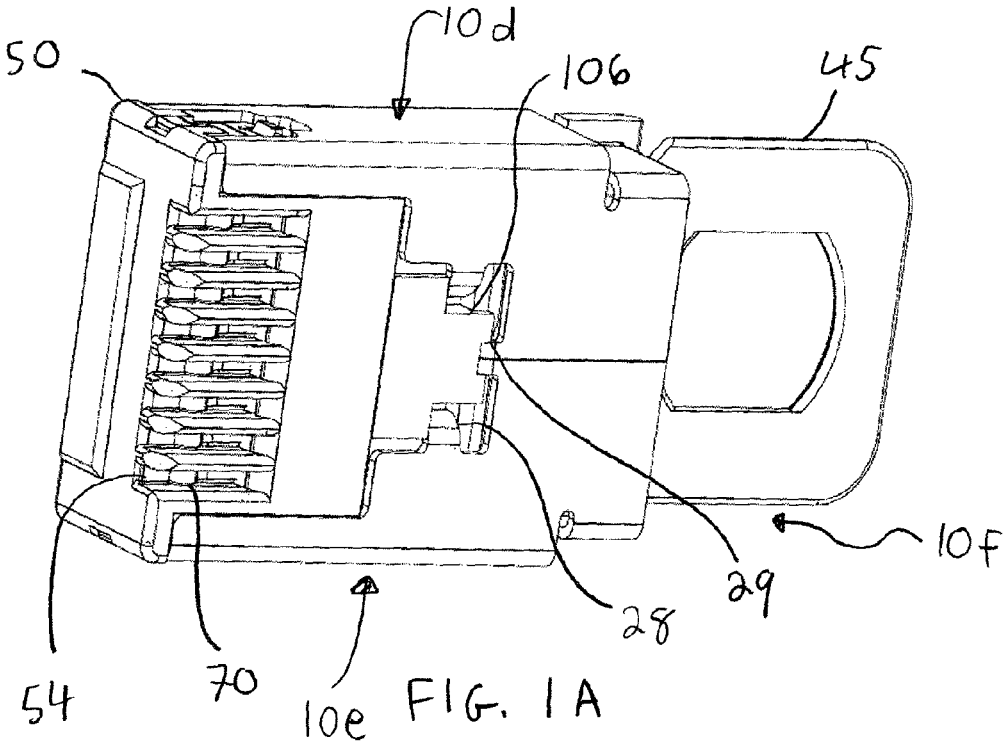
FIG. 1A illustrates another perspective view of the connector depicted in FIG. 1.

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

When upgrading a local area network, one common desire is to be able to change the devices on the end and continue to use the existing cables. Fiber optic cables tend to be well suited for this as it is often possible to send additional wavelengths of light over the same optical cable if there is a desire to increase the data rate. Many networks, however, are copper wires, typically in a twisted pair configuration. Twisted-pair cables are relatively simple to route, are resistant to damage during installation and have provided acceptable data rates.

The continued information explosion, along with the recent determination that it would be beneficial to be able to stream much higher bandwidth than is currently possible over most home networks makes existing networks somewhat constraining. For example, a 100 mbps Ethernet connection is unlikely to be sufficient to allow for multiple high definition streams, particularly if lossless audio is included. Furthermore, uncompressed high definition streams (which require less computation power to process as there is no need to compress and uncompress the stream) are expected to require 3 Gbps or more. Therefore, it has been determined that a system that could allow for increased data rates over existing twisted pair cable would be desirable.

Before turning to the figures, however, it should be noted that a transmission system is a sum of it parts. In other words, a signal transmitted from a first circuit board to a second circuit board must travel the path between the two circuit boards. Therefore, the depicted connector systems can be used in Gigabit Ethernet and 10GBASE-T Ethernet systems but the performance of the transmission system will vary based on a number of things such as the performance of the cable (whether it is Cat 5, Cat 5e or Cat 6 cable, for example) and the level of the signal and the noise of the environment. For shorter segments, which tend to experience less noise due to external signals, it is expected that the need for magnetic filtering can sometimes be avoided. For longer segments or for applications where improvements to the signal to noise ratio would be a benefit, however, the use of magnetic filtering as disclosed may prove to be particularly beneficial.

Turning to FIGS. 1-15, features that may be used with a first embodiment of a plug connector are disclosed. A connector 10 includes a cage 20 that is depicted as wrapped around a housing 50. An actuator 43 is provided and as depicted includes a pull tab 45 with an aperture 46. The aperture 46 can be sized to be gripped with a finger or with a tool. As can be appreciated, the depicted design provides a low profile. If desired, however, the pull tab could omit the aperture and include steps or a textured surface.

Figure 1B:
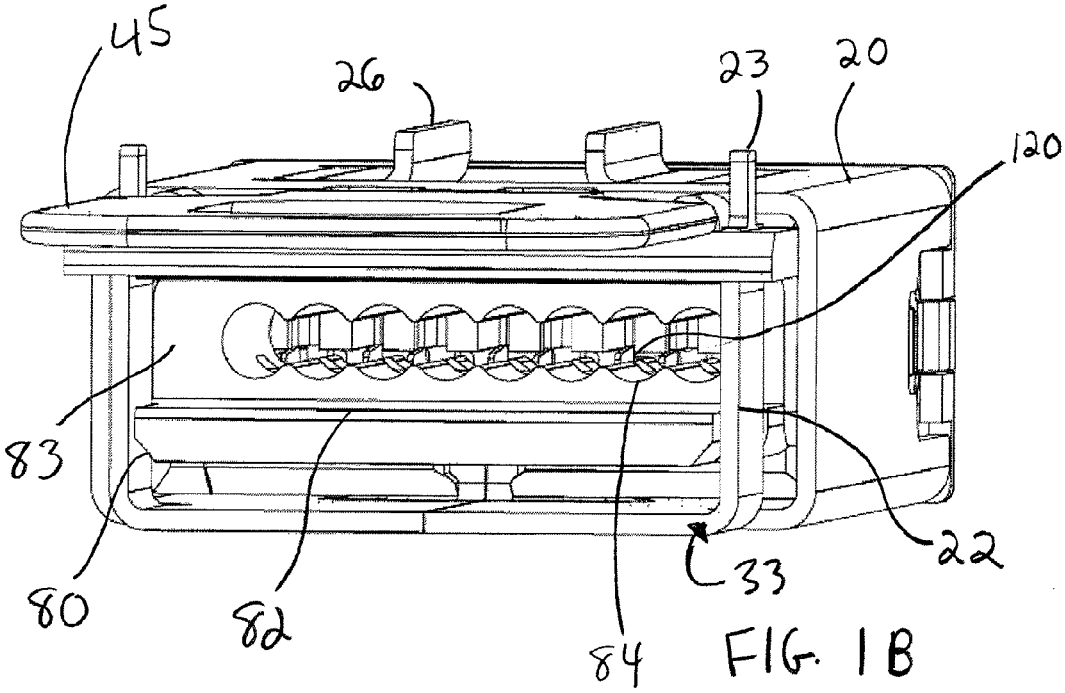
FIG. 1B illustrates another perspective view of the connector depicted in FIG. 1.
Figure 27:
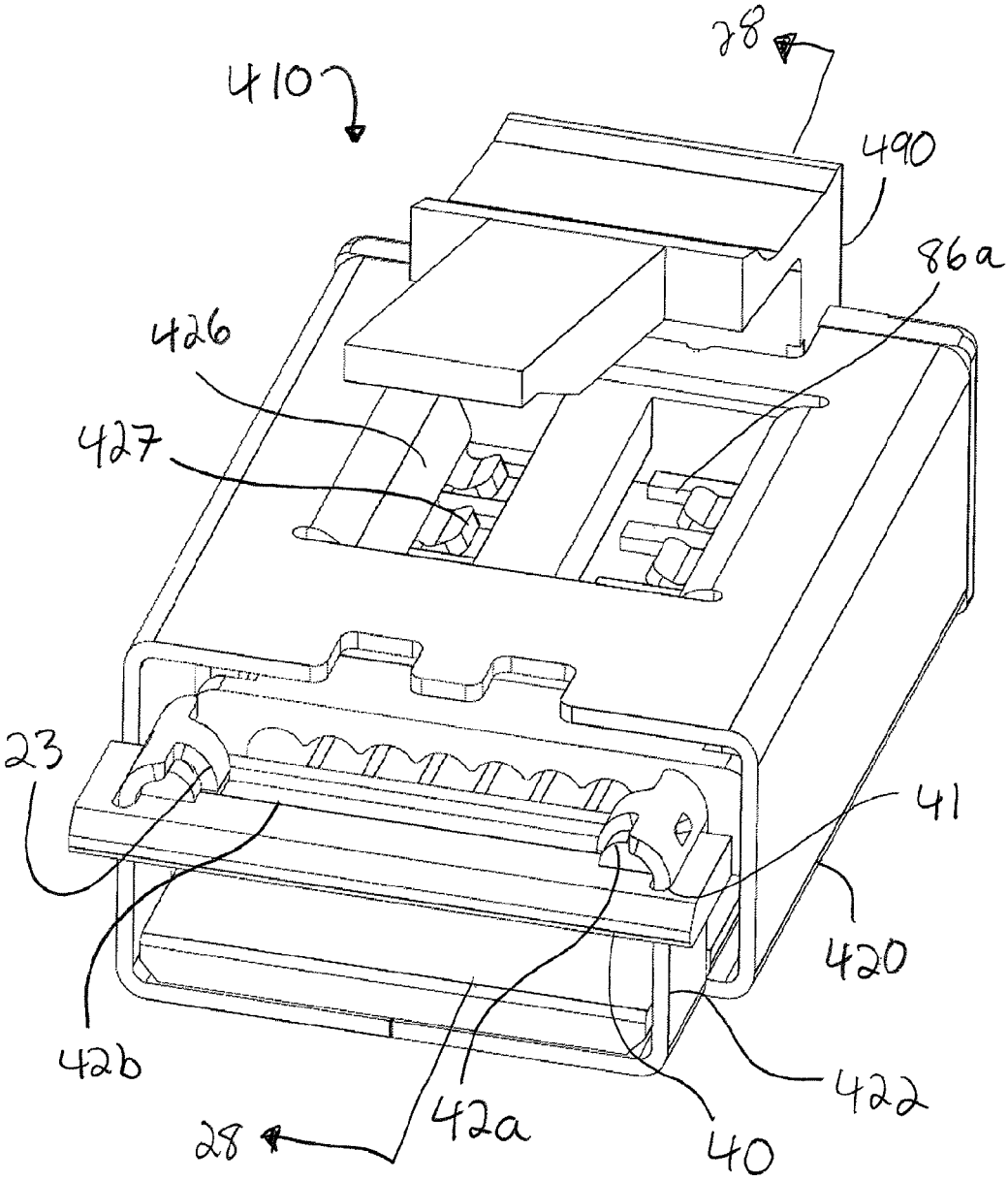
FIG. 27 illustrates a perspective view of another embodiment of a connector with the connector being in a crimped position.
Figure 28:
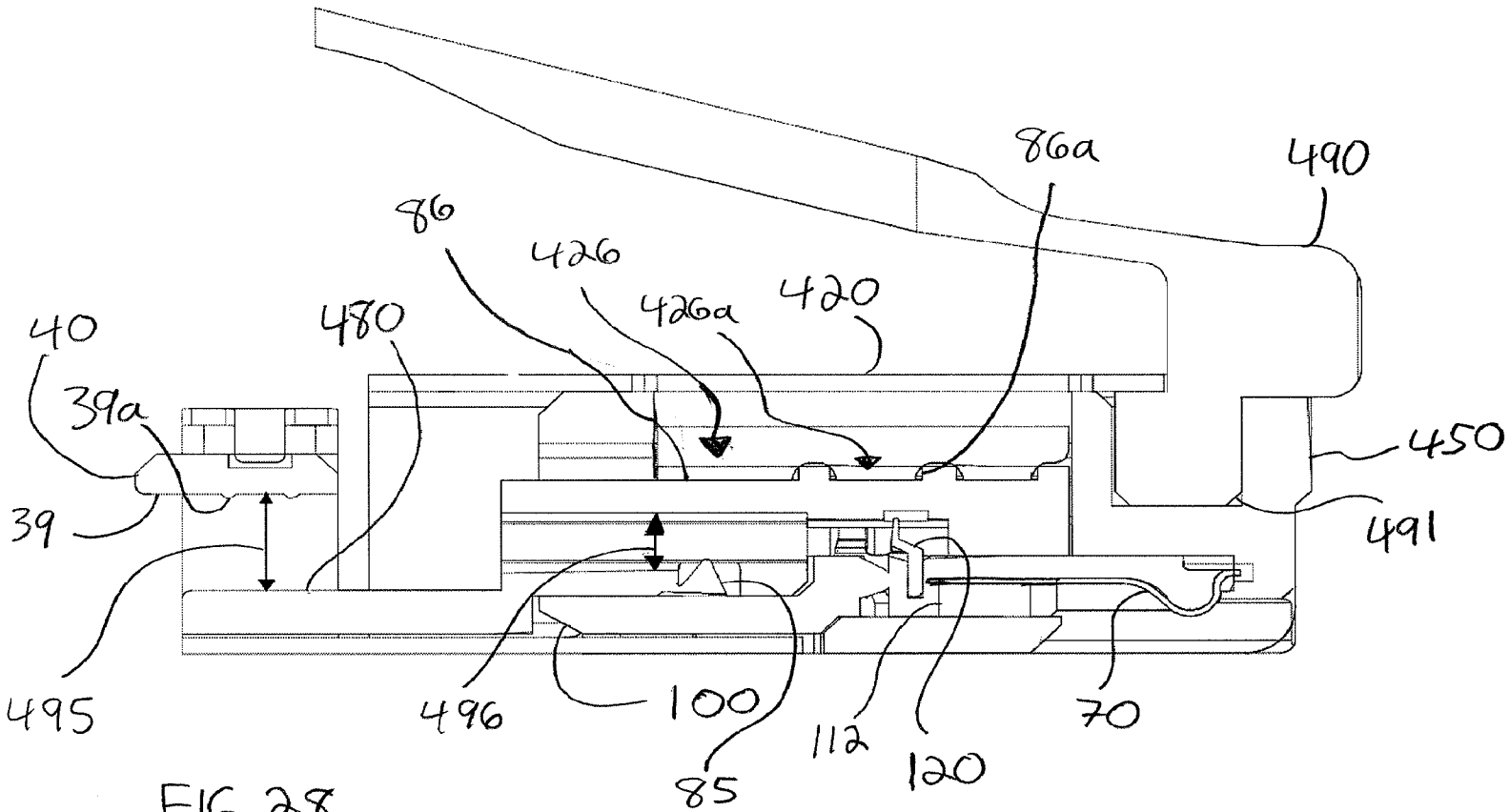
FIG. 28 illustrates a cross section of the connector depicted in FIG. 27 taken along the line 28-28.

On a first side 10*a* of the connector (which also includes sides 10*b*, 10*c*, 10*d*, 10*e* and 10*f*), a crimp tab 26 is provided in the cage 20 (as depicted, two crimp tabs 26 are disclosed but a single crimp tab can be used if desired). The crimp tab 26, which is shown in a first position, is configured to be pressed into aperture 61 so that it engages first surface 86 of cable module 60 and in operation presses the cable module 60 toward a leadframe 100. FIGS. 27 and 28 illustrate another embodiment of a crimp tab 426 in a second position. Thus, as can be appreciated, the crimp tab is translated from the first position to the second position once wires are inserted. As depicted, moving the crimp tab from the first position to the second position also translates the wire module 80, 480 from an insert position (as depicted in FIG. 1B) to a crimped position (as depicted in FIG. 28). As depicted, the cage extends around the sides 10*a*, 10*b*, 10*d* and 10*e* (e.g., four sides) so that it can restrain the wire module 80 in position. In an alternative embodiment, the cage 20 could extend around three sides (e.g., 10*a*, 10*d* and 10*e*) but be retained to the housing in a desirable manner. Thus, it is expected that the cage would extend around three or more sides in most configurations.

A relief brace 40 is mounted on legs 22 of the cage 20 and the legs 22 include projections 23. The relief brace 40 includes slots that are configured to allow the relief brace 40 to be mounted to the legs. When crimped, the projections 23 are bent over a retaining ledge 42*a* so that the projections 23 extend into a retaining groove 42*b*. A bottom surface 39, which may include retaining ribs 39*a*, acts to press against a coupled cable once the relief brace is crimped in place and helps provide strain relief for the cable.

Figure 2:
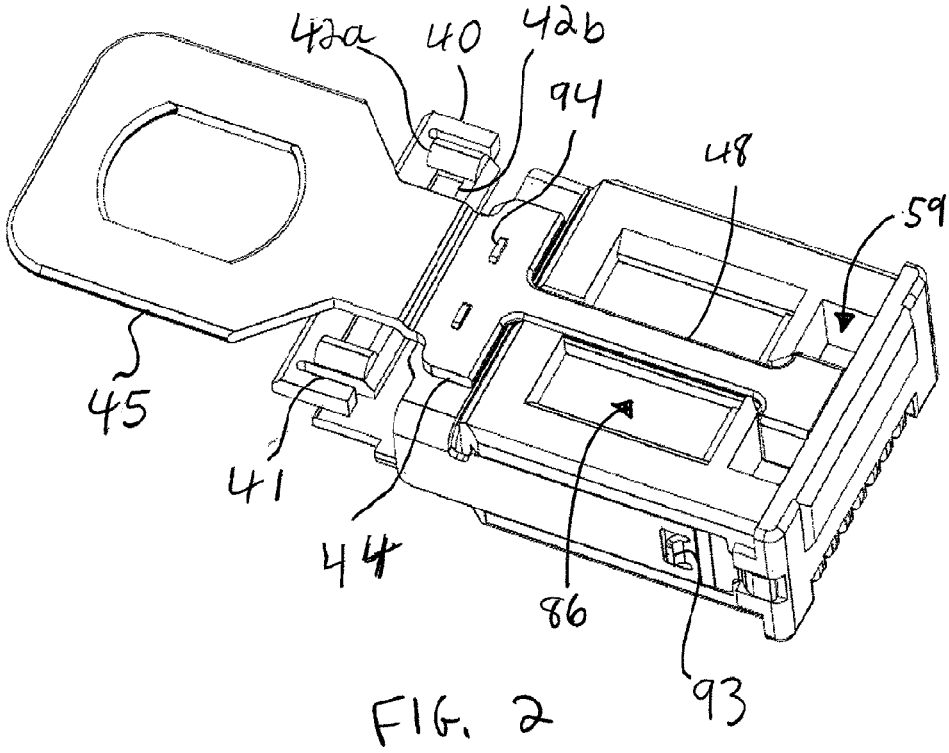
FIG. 2 illustrates a perspective view of a simplified embodiment of a connector with a cage removed.
Figure 1C:
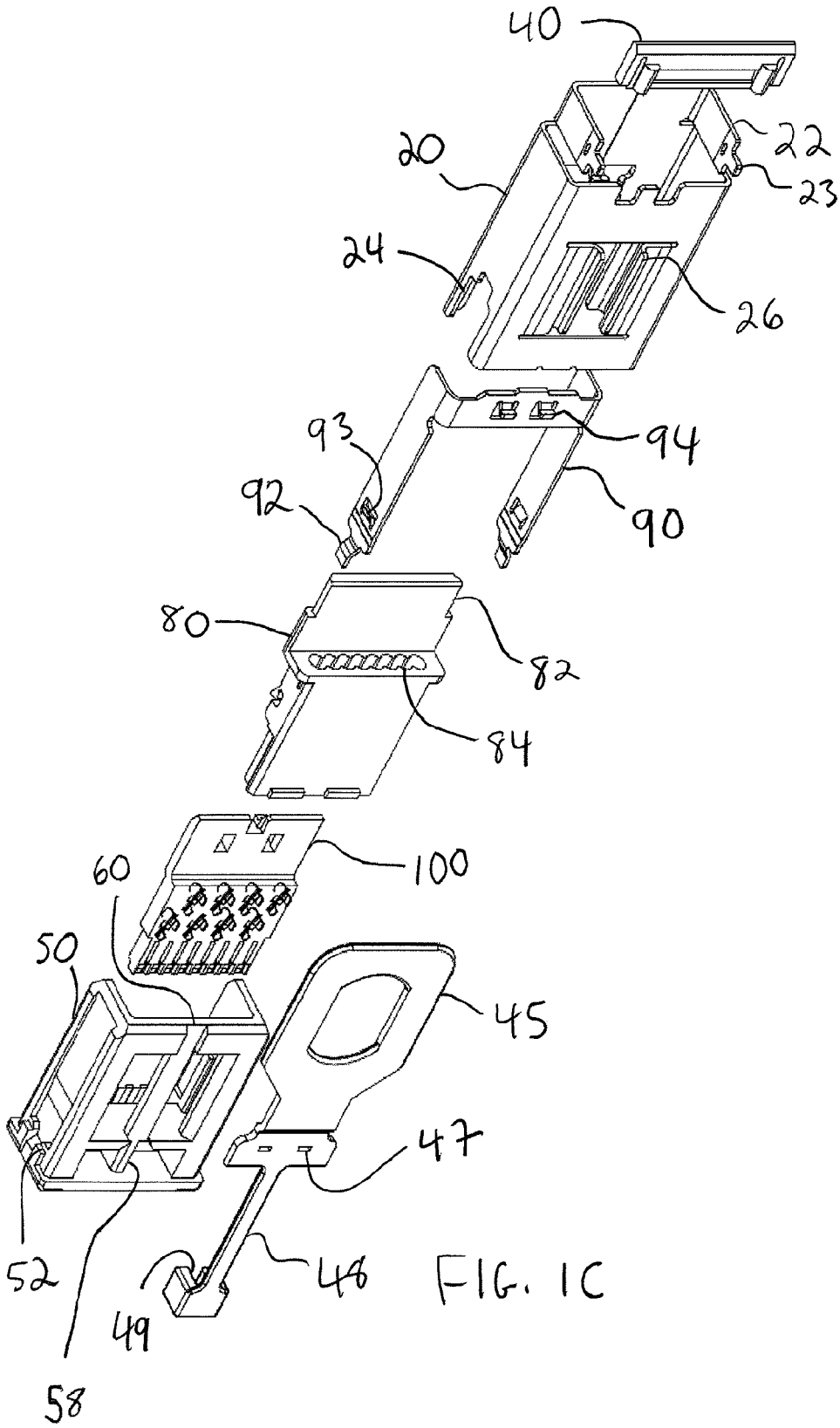
FIG. 1C illustrates an exploded perspective view of the connector depicted in FIG. 1.
Figure 3:
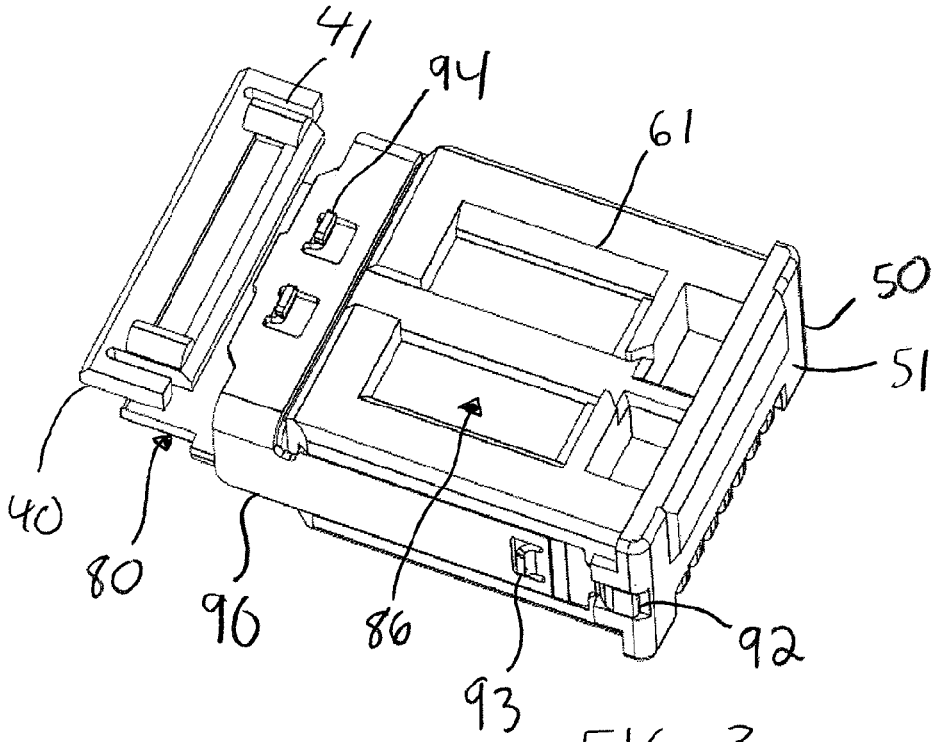
FIG. 3 illustrate a further simplified perspective view of the connector depicted in FIG. 2.
Figure 4:
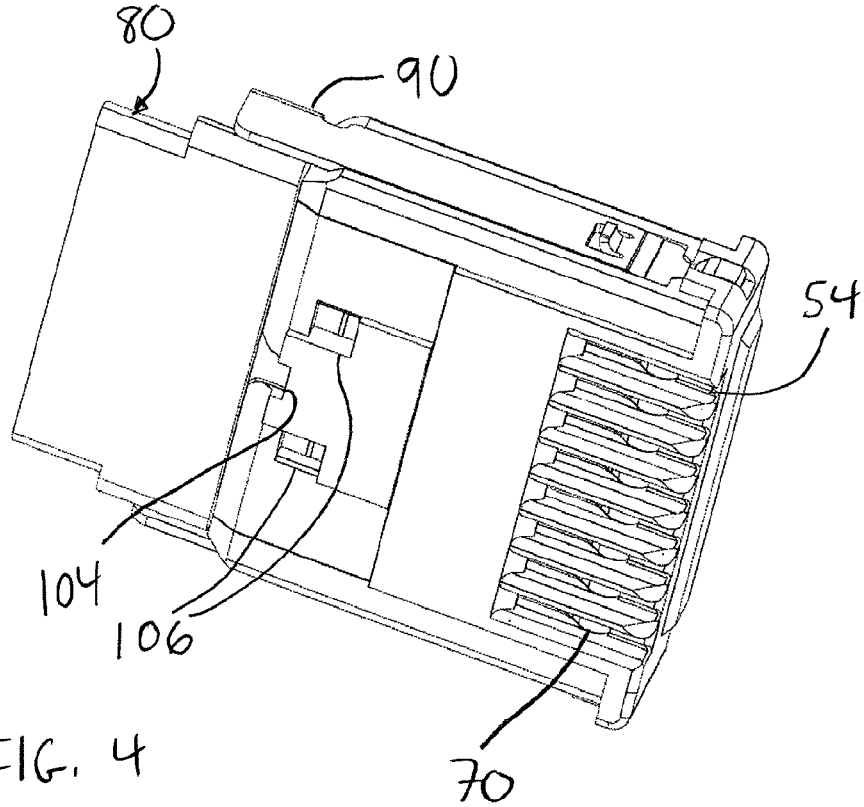
FIG. 4 illustrate a further simplified perspective view of the connector depicted in FIG. 3.
Figure 5:
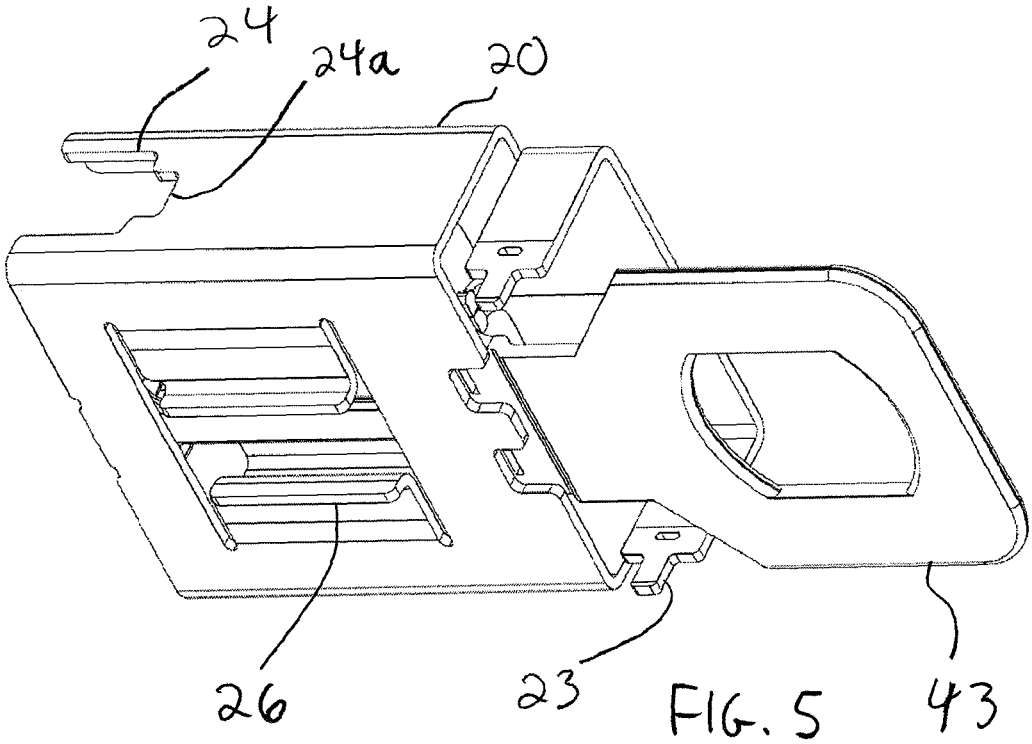
FIG. 5 illustrates a perspective view of a cage and actuator assembly.
Figure 5A:
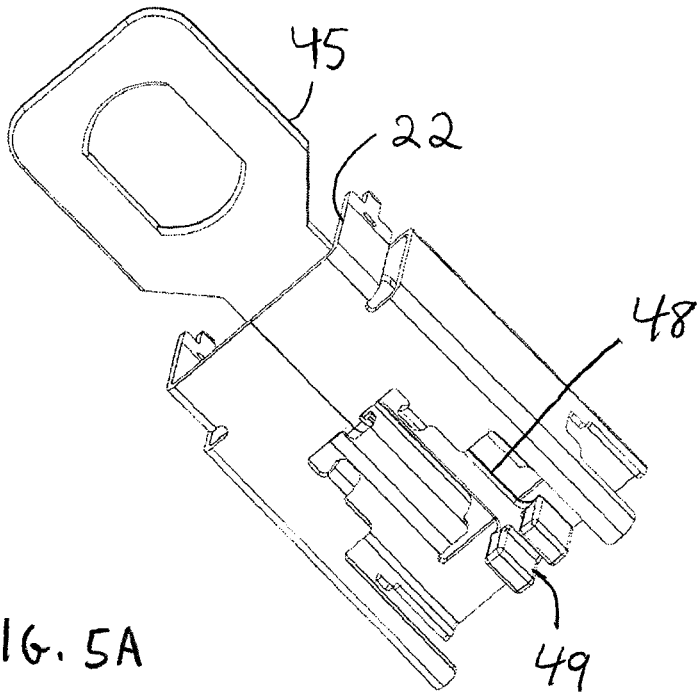
FIG. 5A illustrates another perspective view of the assembly depicted in FIG. 5.
Figure 5B:
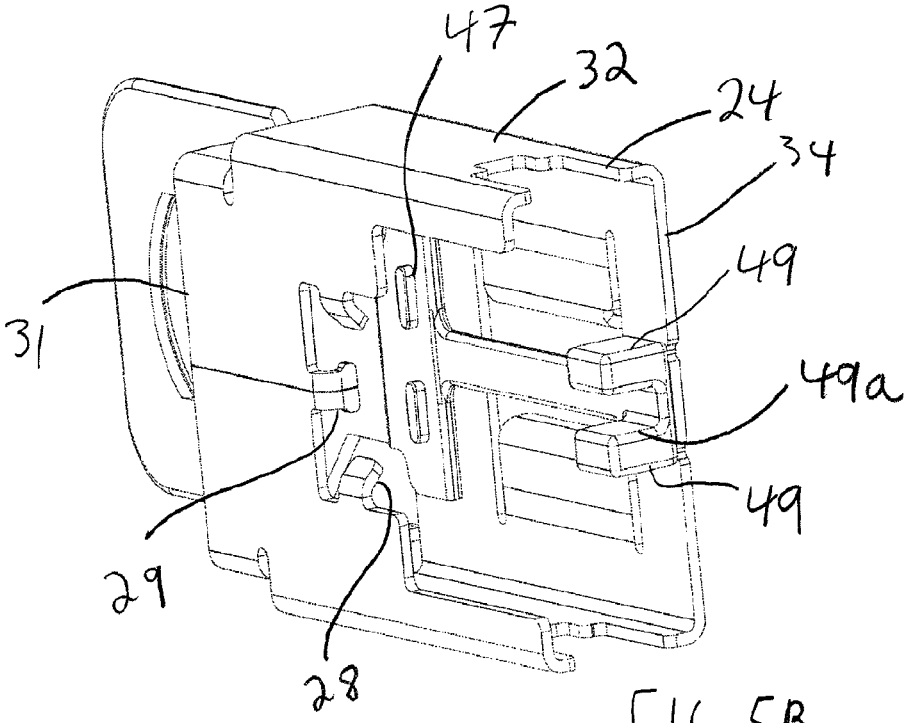
FIG. 5B illustrates another perspective view of the assembly depicted in FIG. 5.
Figure 29:
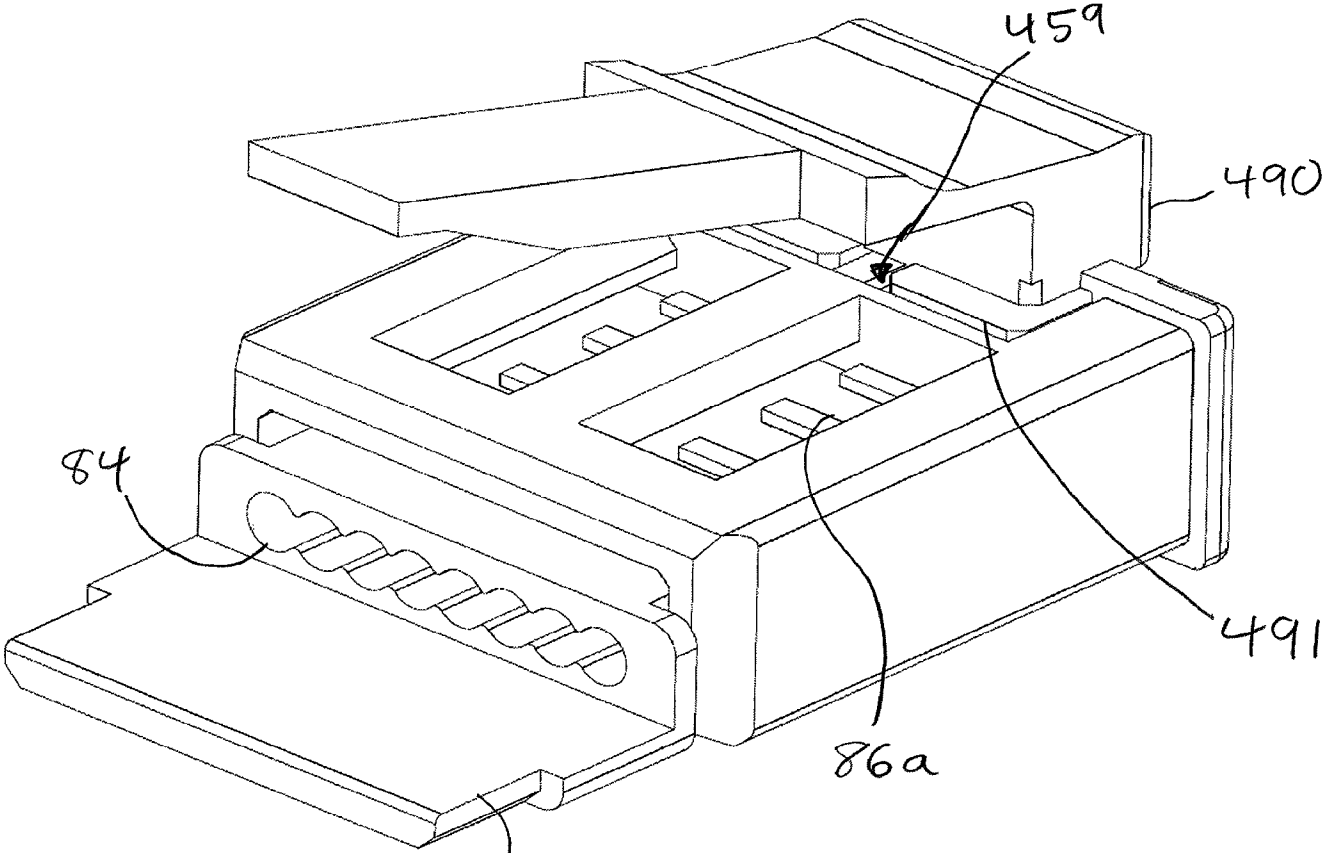
FIG. 29 illustrates a perspective partial view of the connector depicted in FIG. 27 with the cage removed.

As can be appreciated from FIGS. 2 and 27 (which are two different embodiments of a connector without magnetic filtering), different latching systems are possible. FIG. 1-2 show details of a first latching system that includes the pull tab 45 with actuation portion 44 that engages tabs 94 of latch release 90. FIGS. 27-29 show an embodiment where the plug is configured with a latch 490 to match with the conventional RJ-45 form factor. In FIG. 2, when the pull tab is translated in a release direction, the latch release 90 is translated. This causes the release tab 92 to cause a latch mechanism on a corresponding receptacle to be disengaged so that the plug can be removed. To prevent excessive travel of the latch release 90, a hook portion 93 engages an end 24*a* of channel 24. The pull tab is retained in place by pull tab retainer 49, which is configured to engage tab support 58. As depicted, the pull tab retainer 49 include a slot 49*a* (and is U shaped) and fits over a rib 58. Any other desirable shape could be used but it is beneficial to secure the pull tab retainer in place with the cage 20 so that more complicated fastening designs are not needed. To provide the desired spring back force, a tab body 48 can have a level of elasticity such that the pull tab 45 can be translated to a release position but once the force is removed the tab body 48 will urge the pull tab 45 and the latch release 90 back to an initial position.

As depicted, and to help hold the connector 10 together, the cage 20 wraps around four sides of the connector and fingers 28, 29 engage locking slots 104, 106 to help ensure the connector is securely held together.

The plug 10 includes a plurality of terminals (typically 8 for a connector configured for 4 twisted-pair cable) positioned in terminal slots 54. To electrically couple the terminals to the wires in the attached cable, an outer layer of the cable is removed and the wires that make up the twisted pairs are inserted into wire channels 84 in a face 83 of wire module 80. As depicted, the wire channels 84 and the wire channels include ends 81 that are open on one side. As depicted, the ends 81 are alternatively short and long and include side groove 81, 81*b* that are configured to receive insulation displacement member 120. The wire module 80 includes a ledge 82 that in operation squeezes the cable between the ledge 82 and the bottom surface 39 when the crimp tab 26 presses against surface 86 (which may include ribs 86*a* that can be position between tabs 427 of crimp tab 426—see FIG. 27). It should be noted that if desired, the wire channels can be color coded to help ensure correct assembly.

As can be appreciated, therefore, the cage 20 can include a number of differently configured crimp tabs 26 (as well as a number of variations in the actuator 43). Furthermore, when looking at the embodiment that includes magnetic filter (FIGS. 16-22), it should be understood that the features of the connector that are used to support the magnetics can be readily used in the connector 10. One possible change is that the length of the connector could be increased slightly to account for the space taken up by the choke. Alternatively, some other dimension of the connector could change to account for the additional space required to fit in the magnetic filtering.

Figure 6:
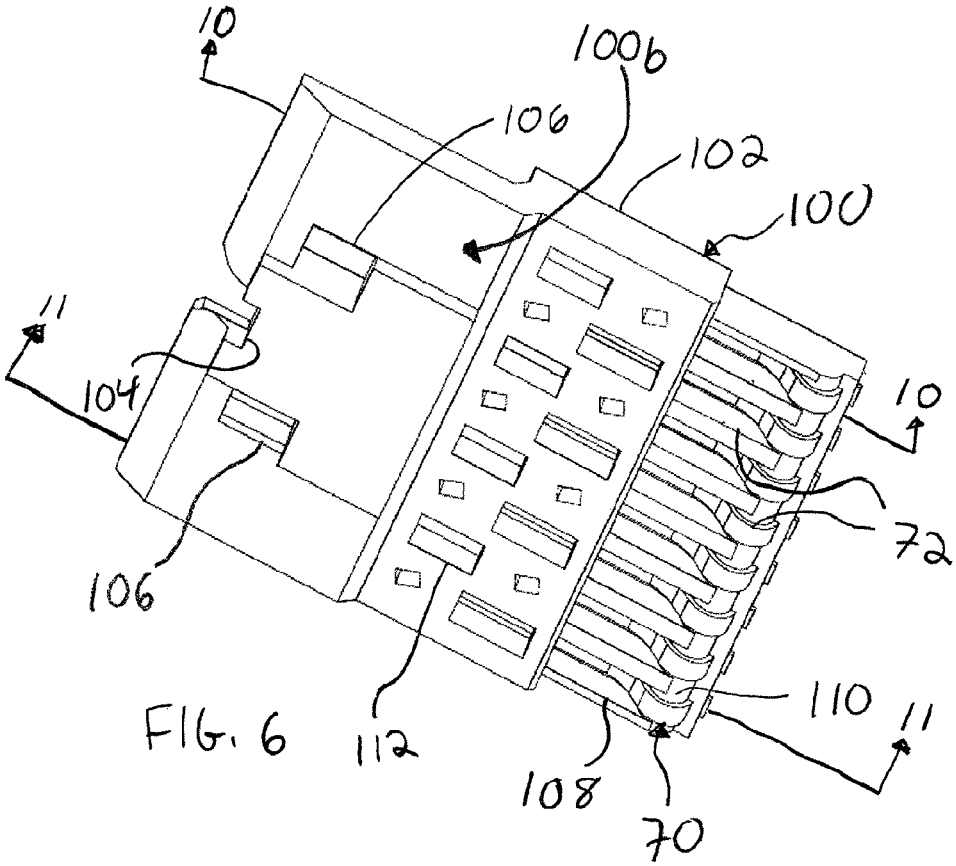
FIG. 6 illustrates a perspective view of an embodiment of a leadframe.
Figure 6A:
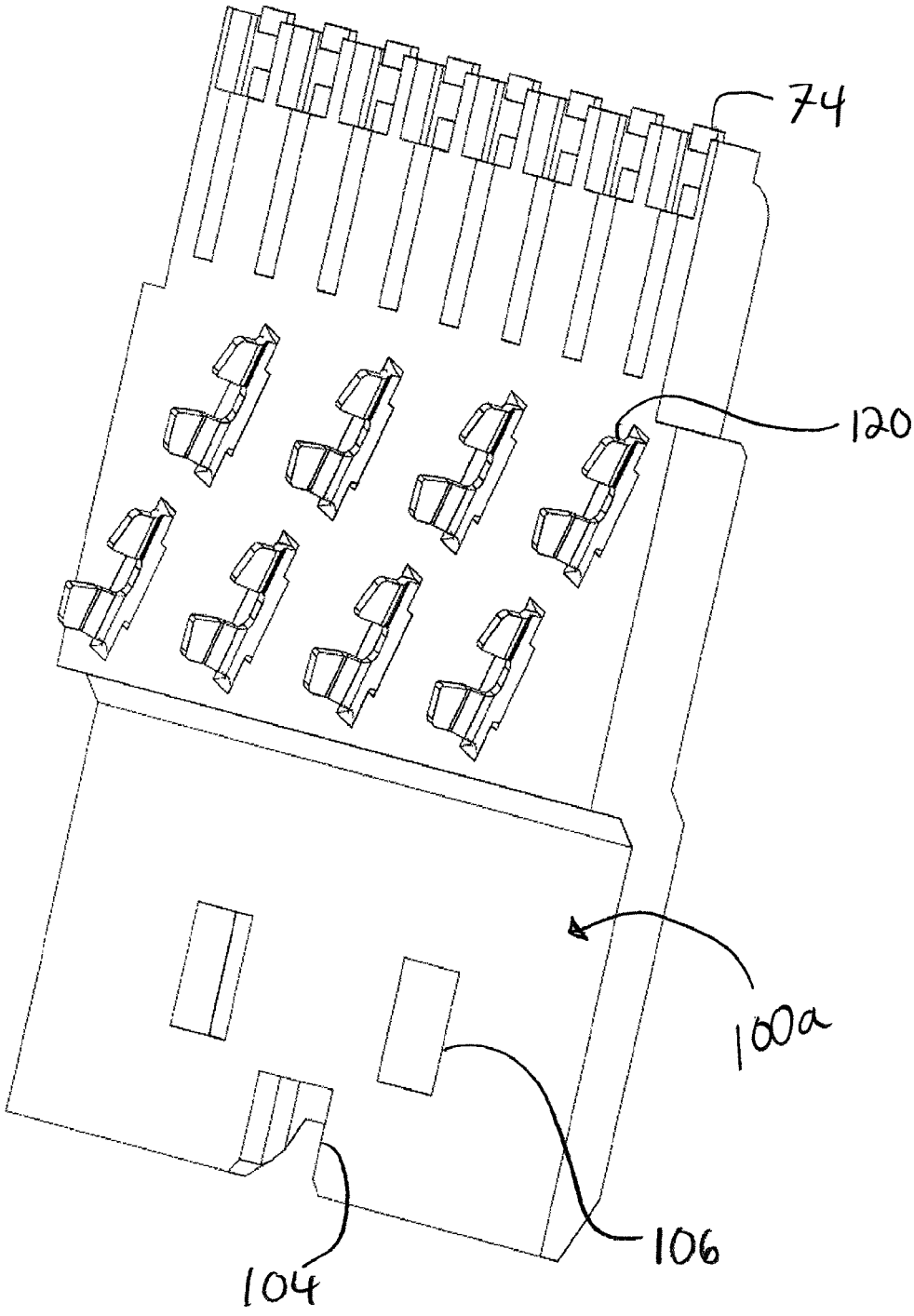
FIG. 6A illustrates another perspective view of the leadframe depicted in FIG. 6.

The connector 10 includes a leadframe 100, which is depicted in FIGS. 6 and 6A. The leadframe 100 supports terminals 70, which as depicted are position on terminal rib 110 in terminal channels 108. The leadframe 100 can be molded on the terminals so that the leadframe 100 has the terminal 70 integrated therein and may include an end 74 that extends out of the leadframe. The terminals include a contact 72 and may include a coupling portion 76. The coupling portion 76 allows the terminal to couple to an insulation displacement portion 120, which can be a separate terminal (as depicted) or can be integrated into the terminal 70. As can be appreciated, therefore, the leadframe 100 has a first side 100*a* with insulation displacement portions that engage the wires that form the plurality of twisted-pairs in the cable and the leadframe has a second side 100*b* with contact 72 that engages contacts on a matching receptacle connector.

Figure 7:
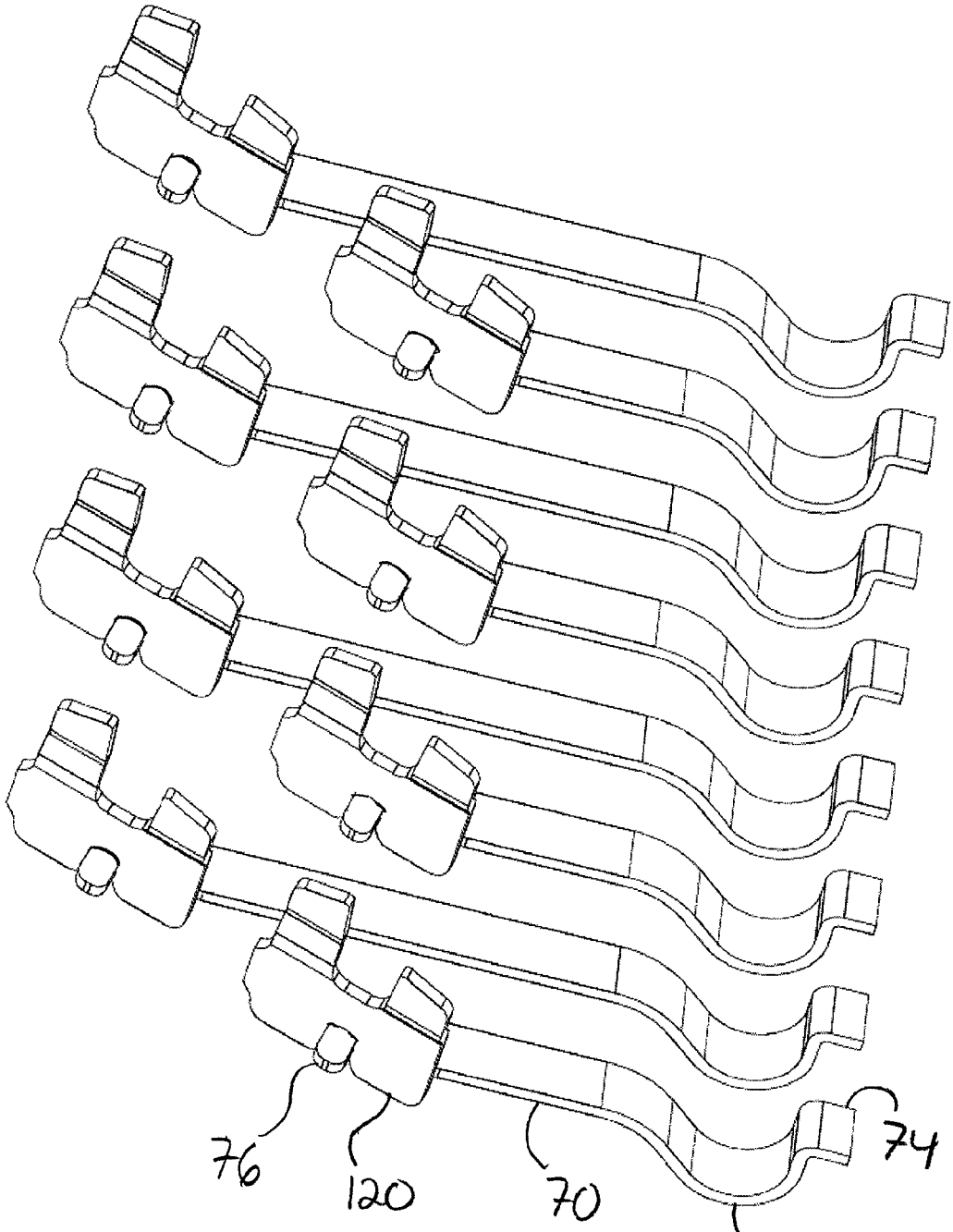
FIG. 7 illustrates a perspective view of an embodiment of terminals.
Figure 8:
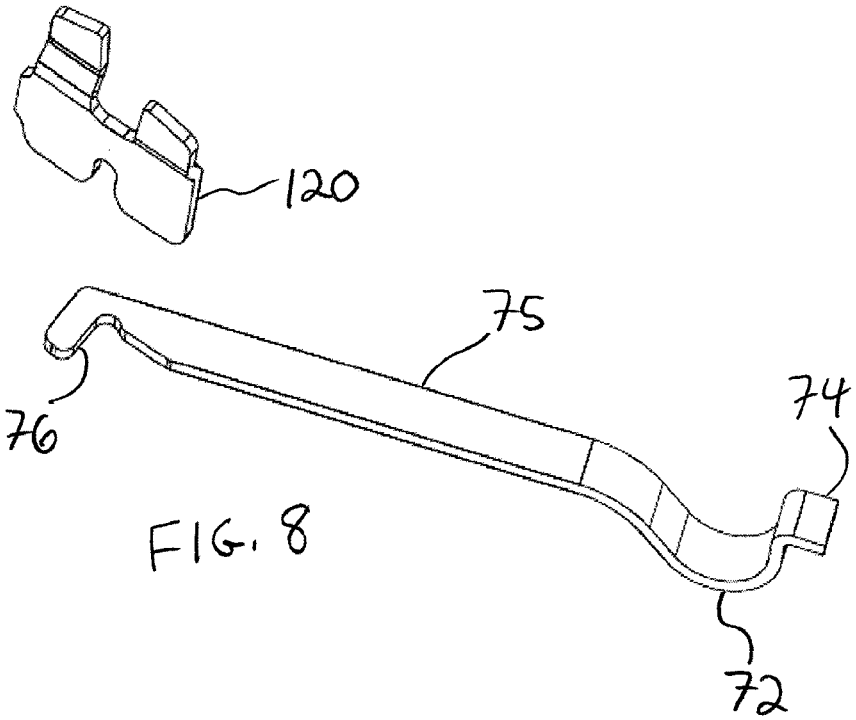
FIG. 8 illustrates a perspective exploded view of a terminal and an insulation displacement portion.
Figure 9:
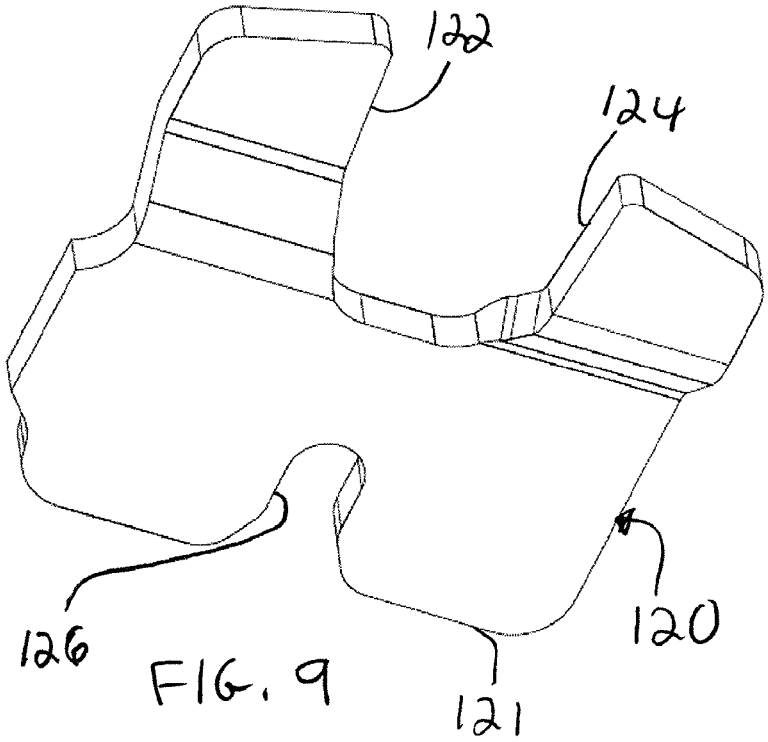
FIG. 9 illustrates a perspective exploded view of an insulation displacement portion
Figure 10:
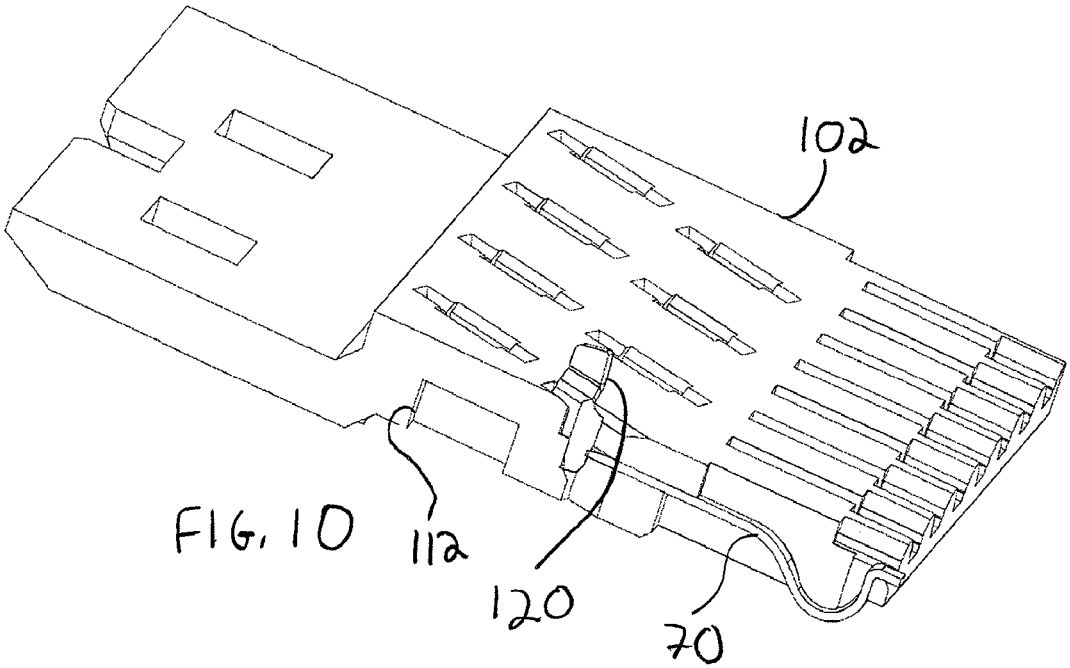
FIG. 10 illustrates a perspective view of a cross-section of a partial leadframe along lines 10-10 in FIG. 6.
Figure 11:
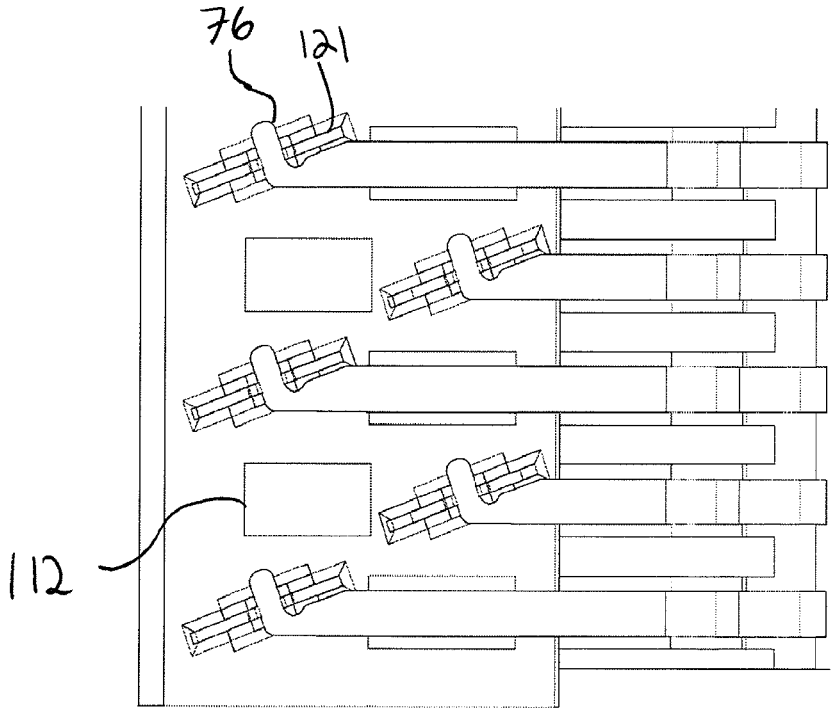
FIG. 11 illustrates an elevated partial plan view of a cross section of a leadframe along lines 10-10 in FIG. 6.
Figure 12:
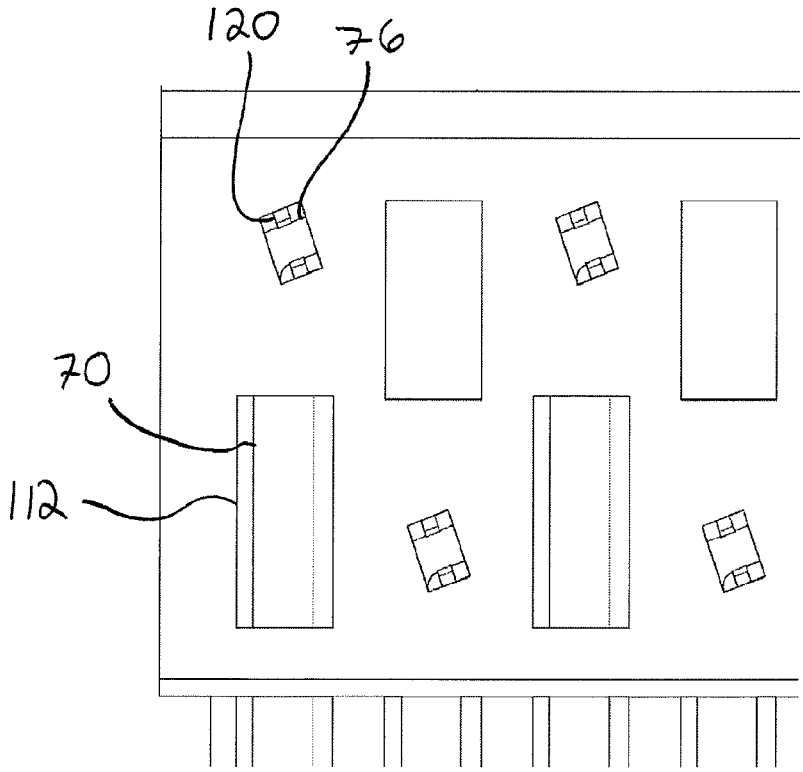
FIG. 12 illustrates an elevated partial bottom view of a cross section of a leadframe along lines 10-10 in FIG. 6.
Figure 13:
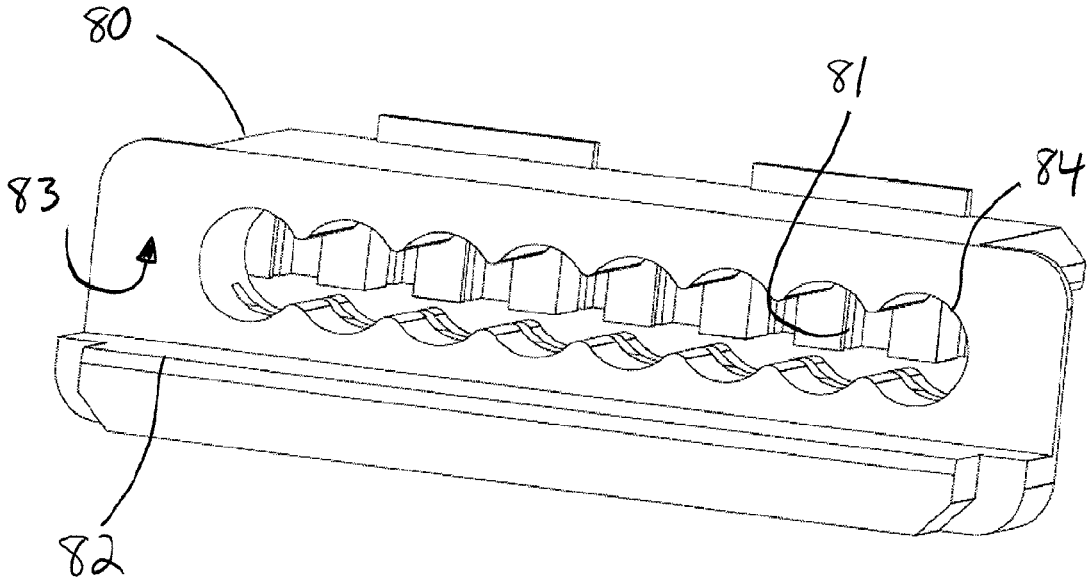
FIG. 13 illustrates a perspective view of an embodiment of a wire module.
Figure 14A:
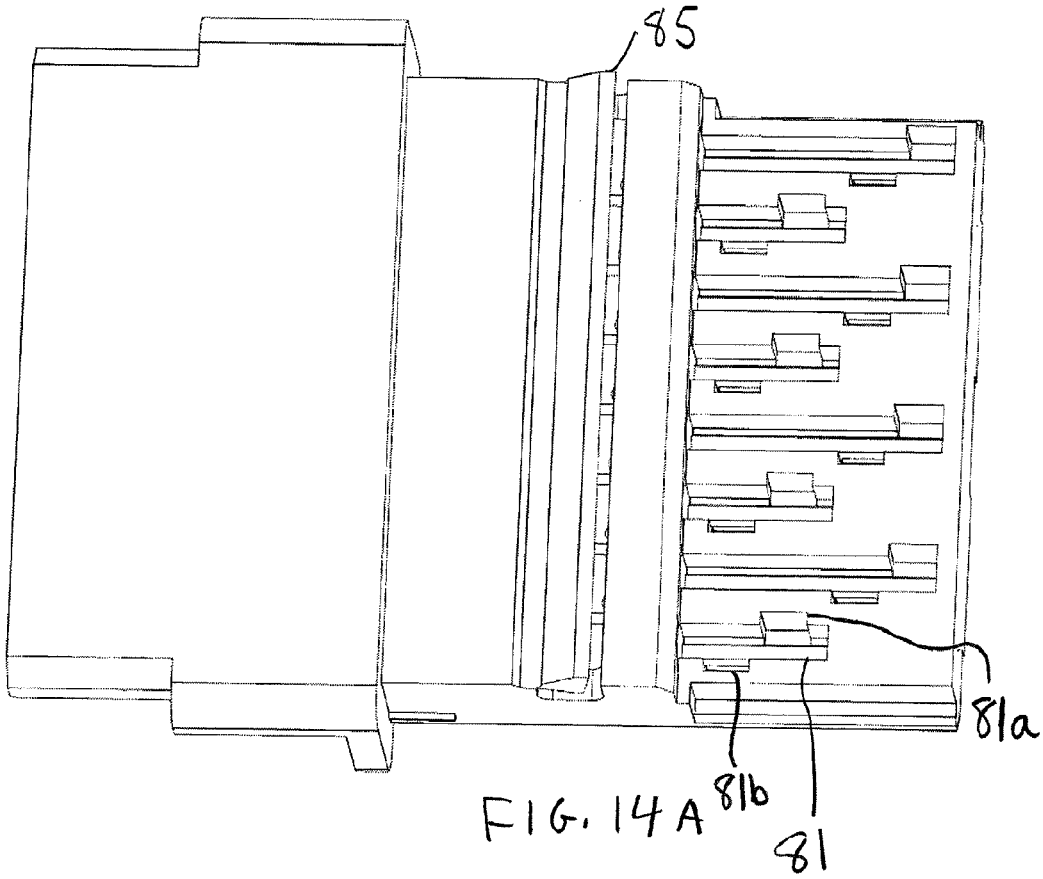
FIG. 14A illustrates another perspective view of the wire module depicted in FIG. 13.
Figure 14B:
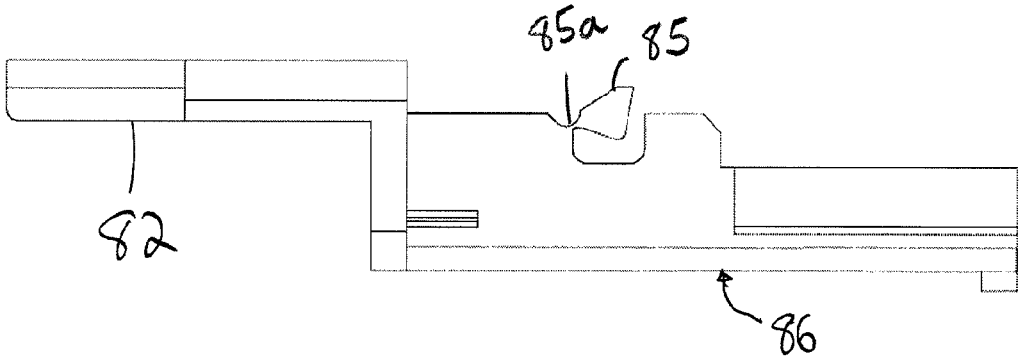
FIG. 14B illustrates an elevated side view of the wire module depicted in FIG. 13.
Figure 15:
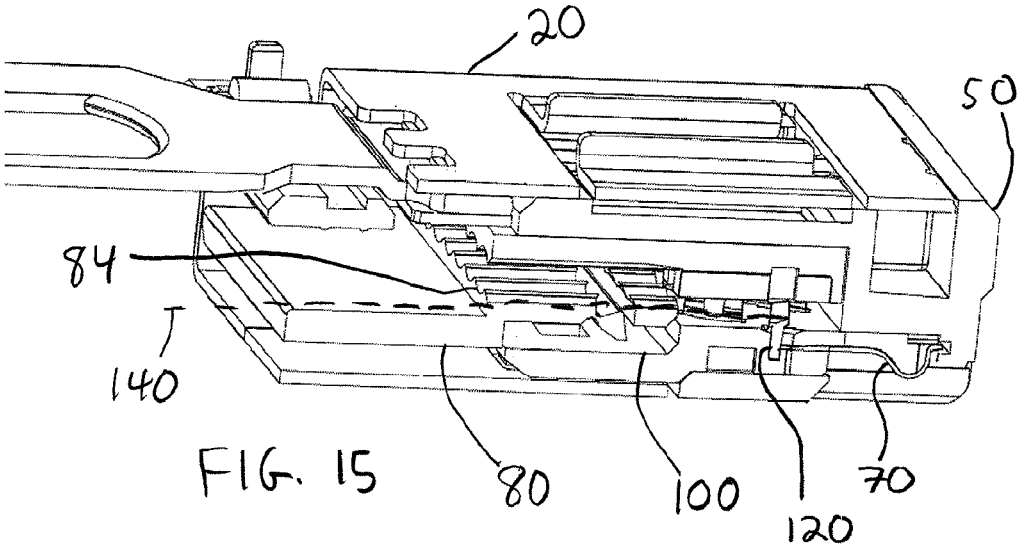
FIG. 15 illustrates a side view of a section taken along the line 15-15 of the connector in FIG. 1.
Figure 16:
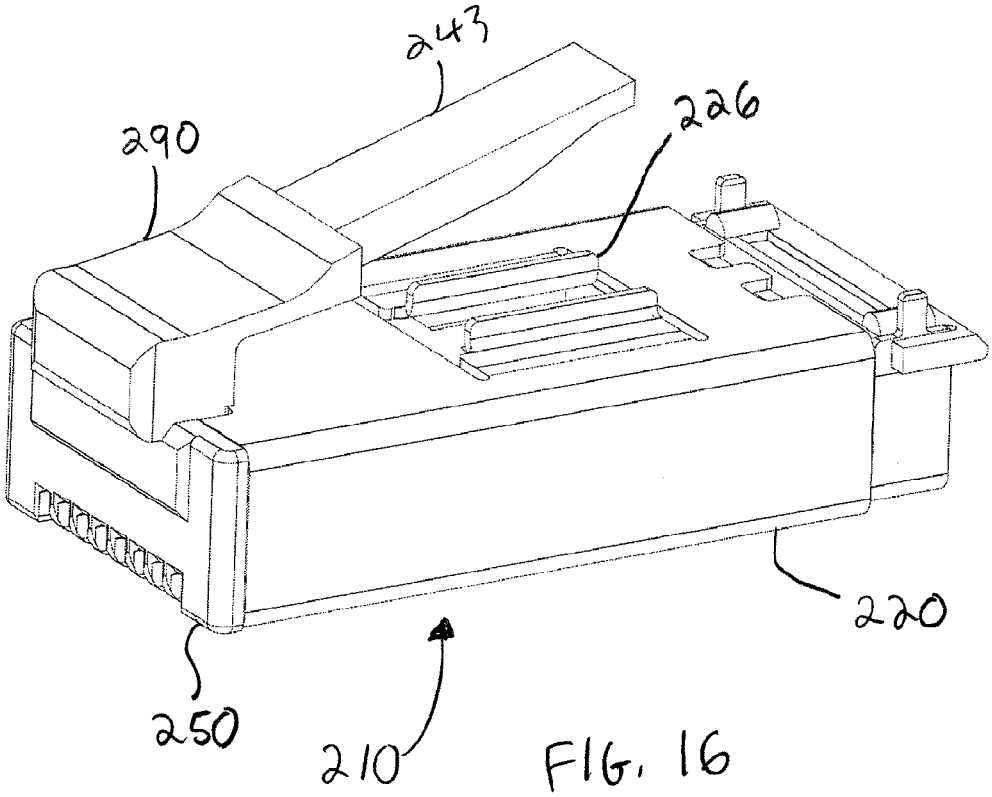
FIG. 16 illustrates a perspective view of an embodiment of a connector.
Figure 16A:
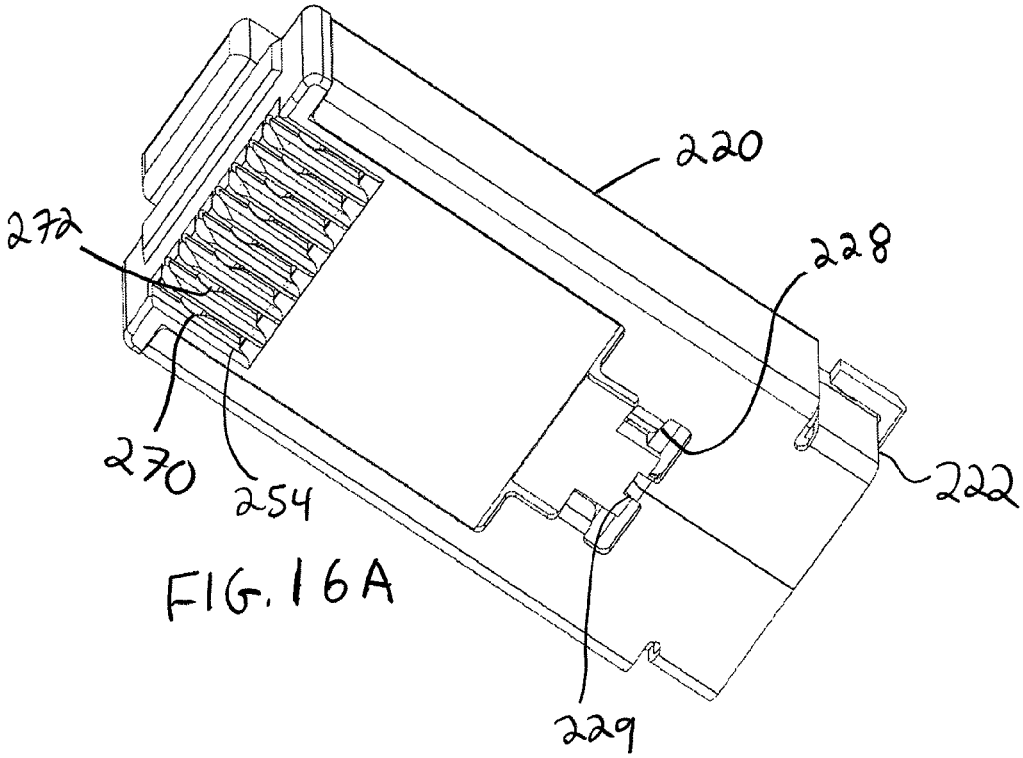
FIG. 16A illustrates another perspective view of the embodiment depicted in FIG. 16.
Figure 17:
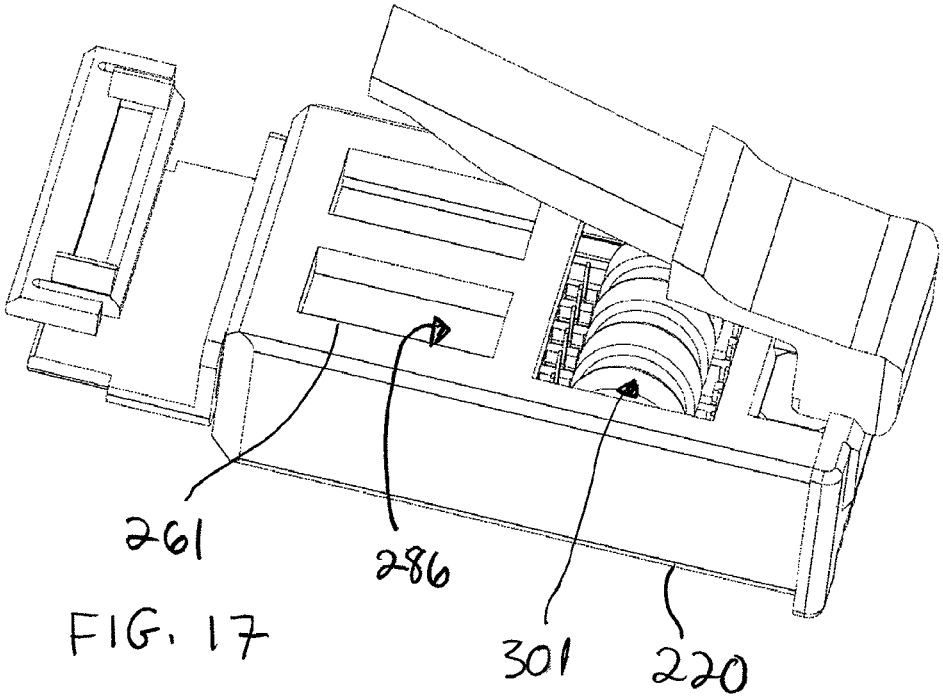
FIG. 17 illustrates a perspective view of a connector with a cage removed.
Figure 18:
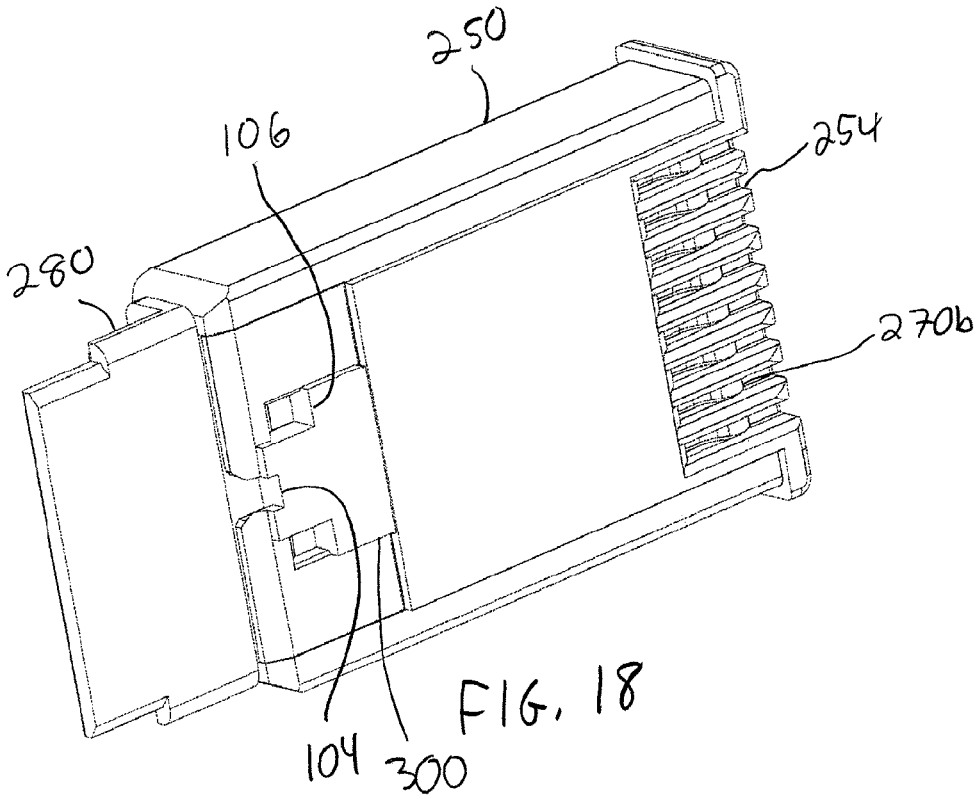
FIG. 18 illustrates a perspective view of the partial connector depicted in FIG. 17
Figure 18A:
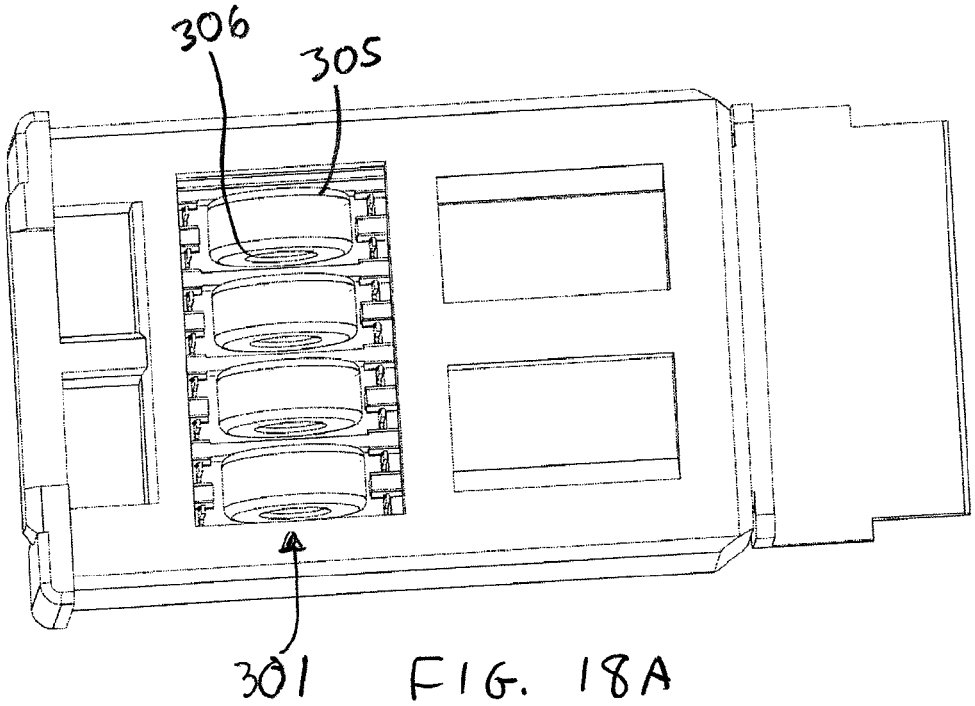
FIG. 18A illustrates a perspective view of a connector with a latch removed.

As can be appreciated from FIGS. 6-7, the insulation displacement portions 120 are alternatively positioned in two rows. This slightly increases the length of the connector but reduces the width so that the leadframe 100 can be used in a RJ-45 connector form factor. As the contact 72 are all aligned in a single row, a body 75 of the terminals 70 alternatively has a first length and a second length that is greater than the first length.

The insulation displacement portion 120 includes a base 121 with a terminal receiving slot 126 and two wire engaging flanges 122, 124. The wire engaging flanges 122, 124 are positioned and configured so that when the insulation displacement portion 120 is inserted into the end 81 of the wire channel 84, the flanges 122, 124 pierce the insulation of the wire positioned in the wire channel and provide a solid electrical connection between the wire and the terminal 70.

It should be noted that the depicted connectors are typically used with twisted-pair wires that form a differential mode (for example, 4 twisted-pair wires can be provided in a cable, each forming a differential signal channel). While not desired, in general, it is extremely difficult to avoid the generation of a common mode when using a differential signal channels over twisted pairs. Compared to conventional insulation displacement terminals used in RJ-45 connectors, however, the improved insulation displacement portions, along with disclosed terminal design, substantially reduces conversion of the common mode to differential mode.

To provide for higher performance, separation notches 112 in the leadframe 100 may be positioned between adjacent insulation displacement portions 120 in a row. The separation notches act to increase the electrical separation and thus help further reduce cross talk. If desired, further improvements to the performance of the connector would be possible if the insulation displacement portions where alternatively arranged on the top and bottom of the leadframe so as to provide greater isolation between differential pairs, thus reducing cross talk and helping to improve the signal to noise ratio.

FIGS. 16-21 illustrate another embodiment of a connector 210 that is similar in many respects to the embodiment depicted in FIGS. 1-15. A cage 220 includes crimp tabs 226 and is positioned around a housing 250. As the connector 210 is designed to be compatible with the RJ-45 connector form factor, however, a latch release 290 with a lever 243 is provided. The latch 290 can be integral to the housing 250 or it can be separate as depicted in FIGS. 27-29 (e.g., a latch 490 can include a latch base 491 that is secured in a housing 450 via a cage 420).

As in the previous embodiment, the cage 420 includes fingers 428, 429 that engage locking slots in a leadframe 300. Similarly, terminals 270 are positioned in terminal slots 254.

One difference between the previous embodiment and the embodiment depicted in FIGS. 15-21, however, is the inclusion of magnetics 301 (e.g., structure to provide magnetic filtering). Magnetic filters, such as ferrite cores, are known to provide a filtering effect and have been used to reduce common mode energy but prior to the depicted embodiments such magnetics were not placed in connectors as depicted. Instead, the magnetics were located after the connector contact interface (e.g., in the receptacle). While using magnetic filtering after the contact interface (e.g., in the receptacle) is capable of filtering common mode noise, the filtering is less effective if the common mode energy has already been converted to differential mode energy in the contact interface.

The embodiment depicted in FIGS. 15-21, therefore, increases the effectiveness of the filtering by filtering the common mode energy before significant common mode to differential mode conversion takes place. In particular, the depicted connector is relatively balanced for the frequency range of interest between the cable and the magnetics. The magnetics then helps reduce the amount of common mode energy so that any subsequent conversion has less of an impact on the signal to noise ratio. The magnetics 301 thus helps provide further improvements to the signal to noise ratio. This is particularly helpful in the RJ-45 based connector as the legacy based design includes a split signal pair that is more susceptible to noise. With the improved terminal designs illustrated and the use of magnetic filtering, it is expected that 10GBASE-T signaling can occur over Cat 5e cables while still providing acceptable signal to noise ratios for shorter distances and certain applications. Thus, there is a potential that for certain applications it may not be necessary to upgrade to Cat 6a cable. Therefore, as the depicted connectors are designed to be field terminable, they should provide a potential upgrade path for situations where it is desirable to upgrade a network without replacing all the cables.

As depicted, the leadframe 300 includes magnetics 301 (which as depicted consist of a plurality of chokes 305 that include apertures 306) positioned between insulation displacement portions 120 and contacts 272. It should be noted that the magnetics are not required to be so positioned but such placement helps reduce the overall size of the connector, which is generally desirable. More generally, however, it is sufficient to position the magnetics so as to integrate it into the connector so that the magnetics are in the electrical path between the contacts and the insulation displacement.

To place the magnetics 301 in the electric path between the insulation displacement portions 120 and the contacts 272, the terminal can be split into a first terminal portion 270*a* and a second terminal portion 270*b*. The first terminal portion 270*a* includes a first coupling portion 276 and a wire tab 273 and a body portion 275*a* extending therebetween. The second terminal portion 270*b* includes an end 274 and the contact 272 and a wire tab 271 with a body portion extending between the contact 272 and the wire tab 271.

Figure 19:
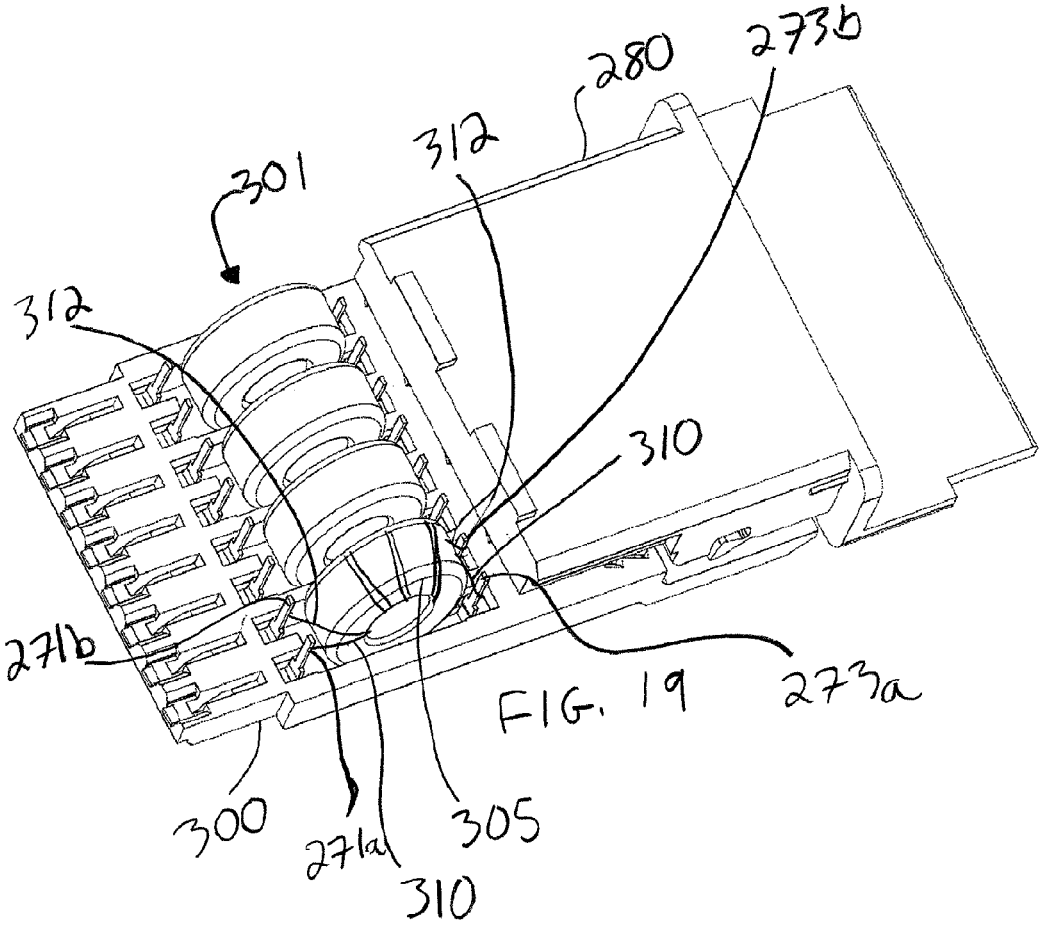
FIG. 19 illustrates a simplified perspective view of an embodiment of a wire module and leadframe.
Figure 19A:
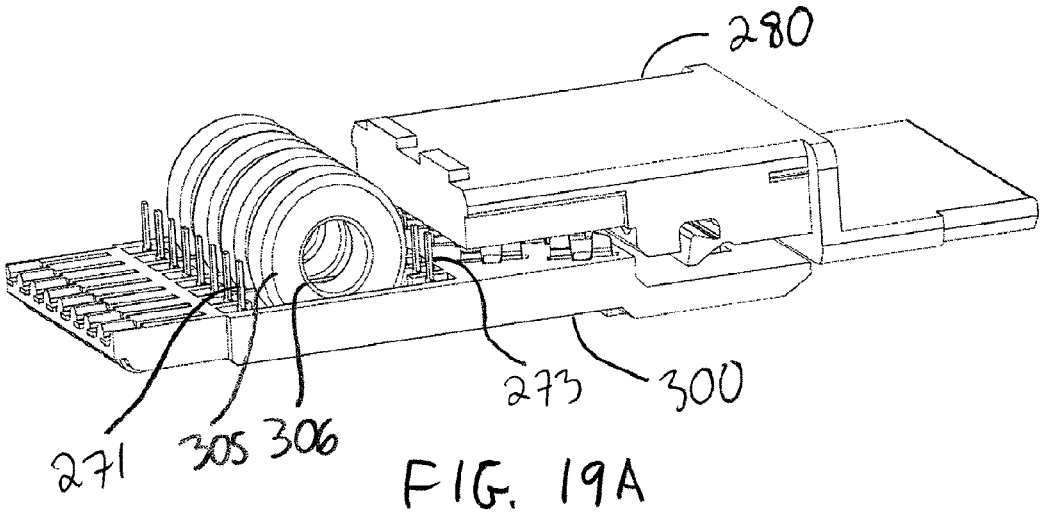
FIG. 19A illustrates another perspective view of the wire module and leadframe depicted in FIG. 19.
Figure 19B:
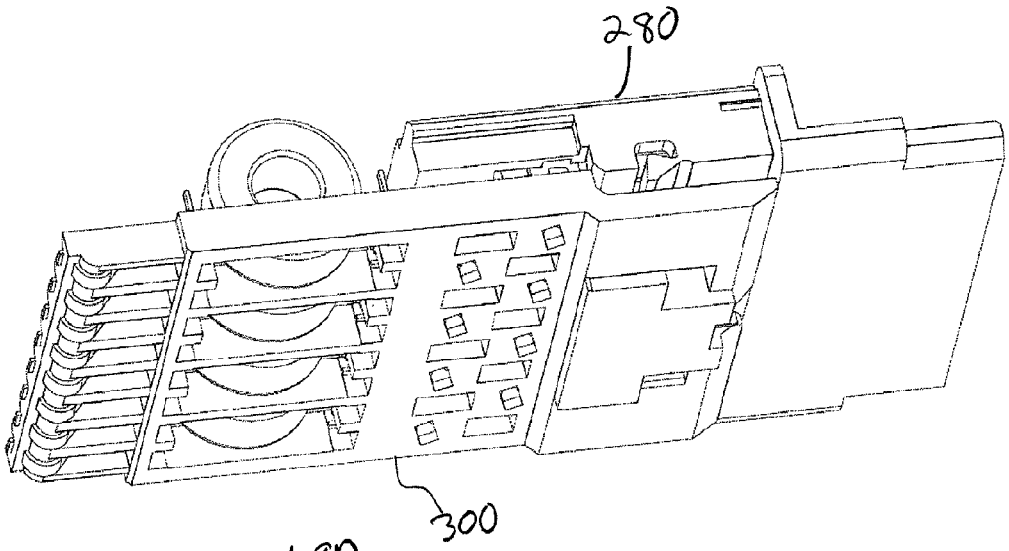
FIG. 19B illustrates another perspective view of the wire module and leadframe depicted in FIG. 19.
Figure 20:
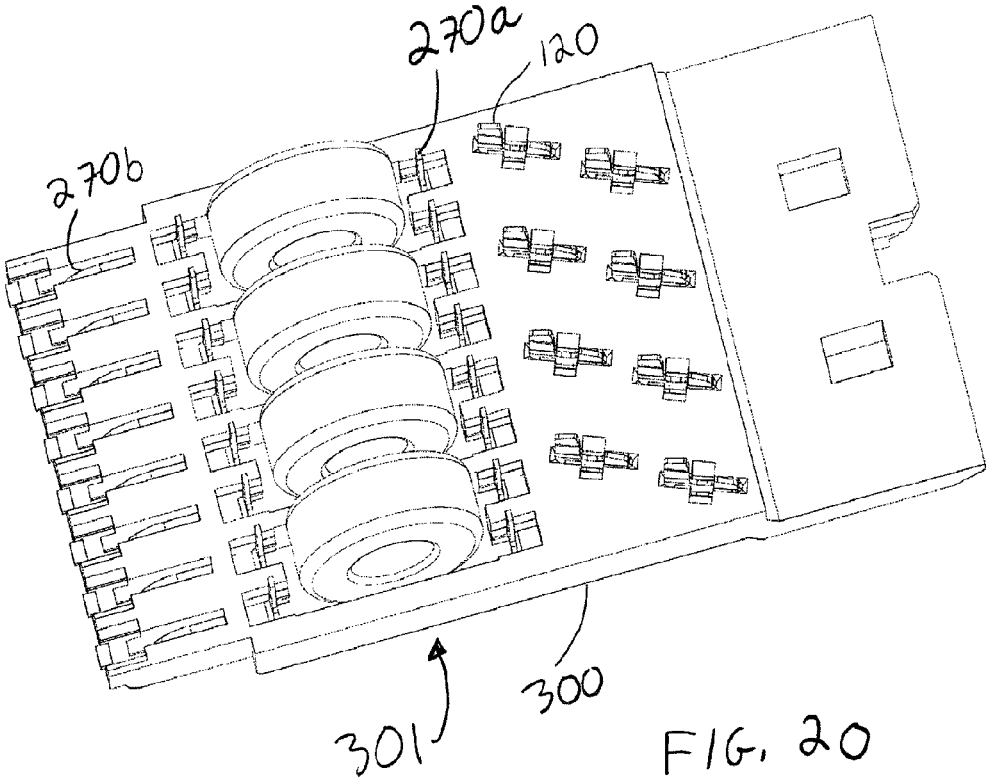
FIG. 20 illustrates a perspective view of an embodiment of a leadframe.
Figure 20A:
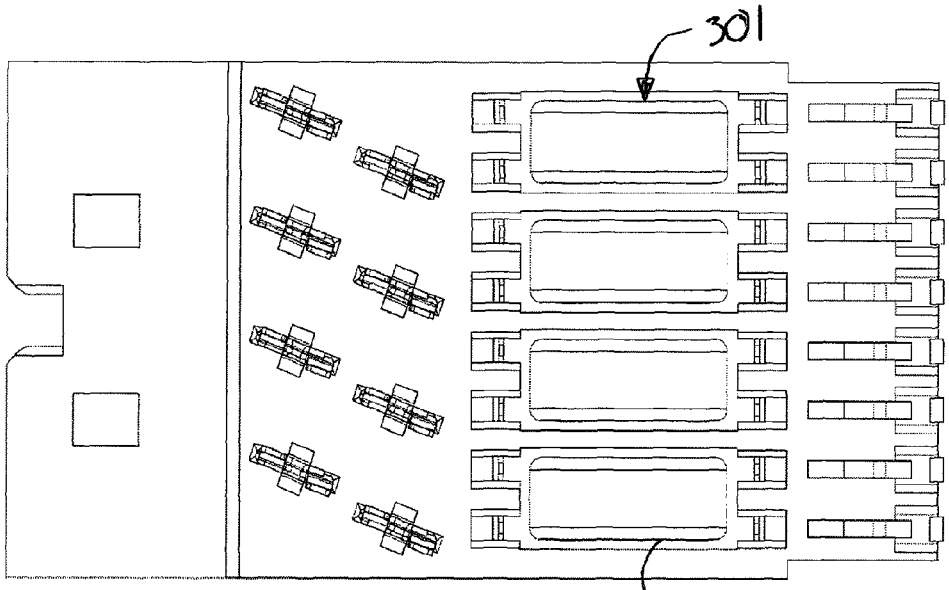
FIG. 20A illustrates a plan view of an embodiment of the leadframe depicted in FIG. 20.
Figure 21:
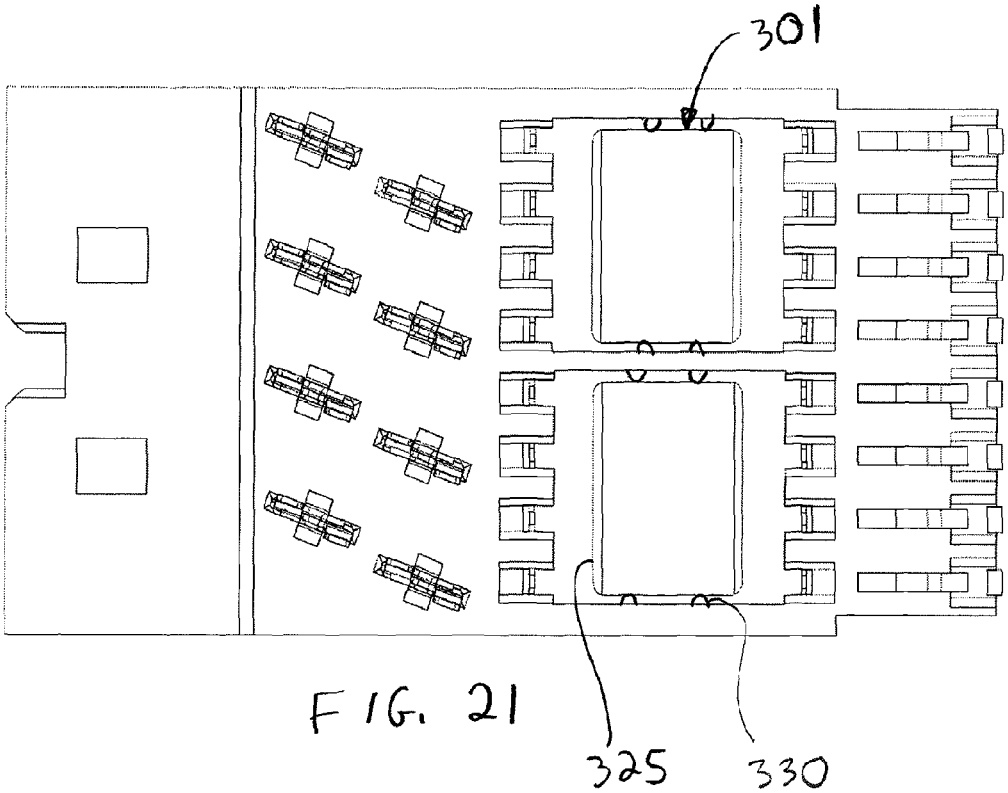
FIG. 21 illustrates a plan view of another embodiment of a leadframe
Figure 22:
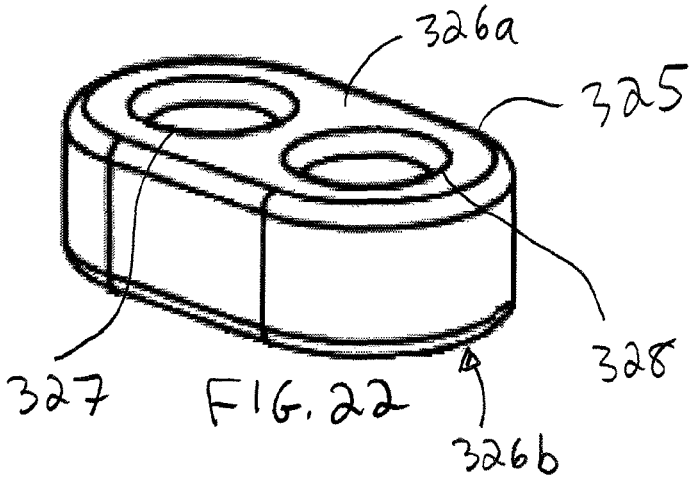
FIG. 22 illustrates a perspective view of an embodiment of a dual-opening choke.
Figure 25:
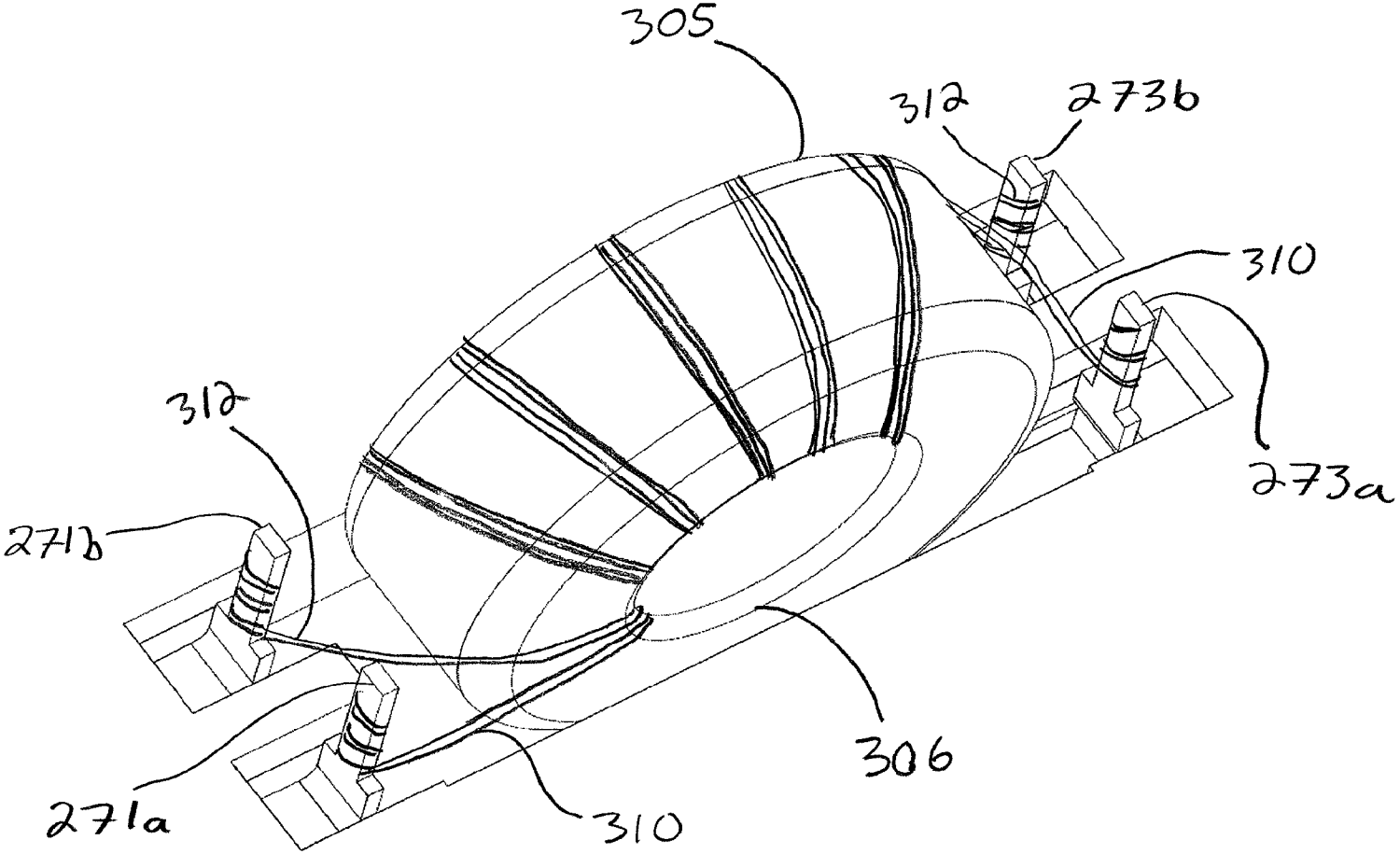
FIG. 25 illustrates a simplified perspective view of an embodiment of a wired choke.
Figure 26:
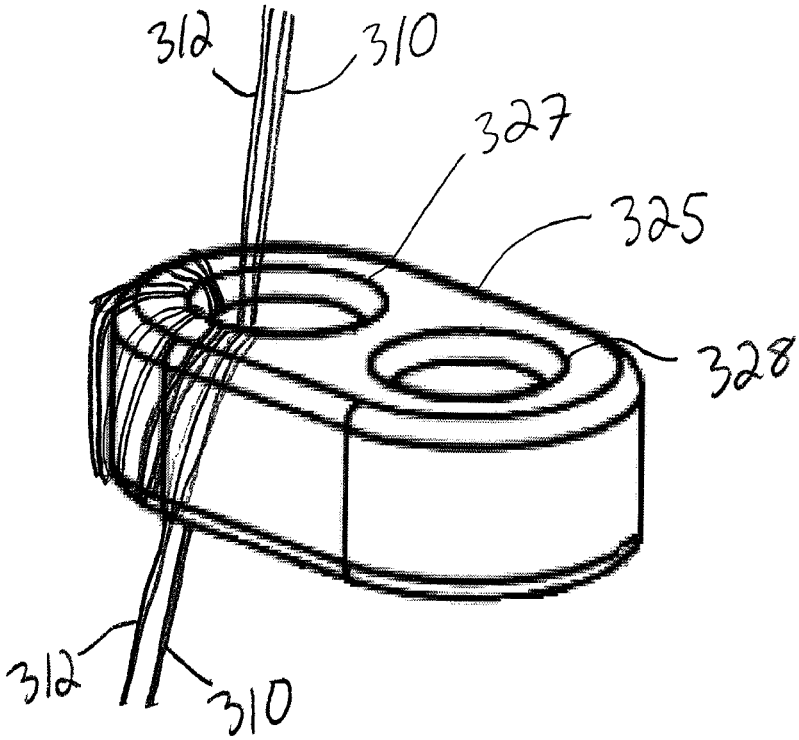
FIG. 26 illustrates a simplified perspective view of a wired dual-opening choke.

As can be appreciated from FIG. 19 and FIG. 25, a wire 310 is wrapped around wire tab 271*a* and extends from there through and around opening 306 of choke 305 a desired number of times and then wraps around wire tab 273*a*. Similarly, wire 312 wraps around wire tab 271*b* and extends from there through and around opening 306 of choke 305 a desired number of times and then wraps around wire tab 273*b*. The wires 310, 312 can be thus wrapped around the choke together but the alignment of the terminals need not change (terminal portion 270*a* can coupled to terminal portion 270*b* for each terminal). It should be noted that the depicted embodiments illustrate chokes that have a toroid or donut-like shape. Other shapes that include an aperture could also be used, such as, without limitation, a rectangular shape. In addition, as it is sometimes more complicated to wind wires through an aperture, a choke that was a cylinder (e.g., a shaped that lacked an aperture) could also be used to filter some common mode energy. Generally speaking a choke that includes an aperture (e.g., a toroid choke) is less likely to saturate and therefore is preferred from a performance standpoint.

Figure 24:
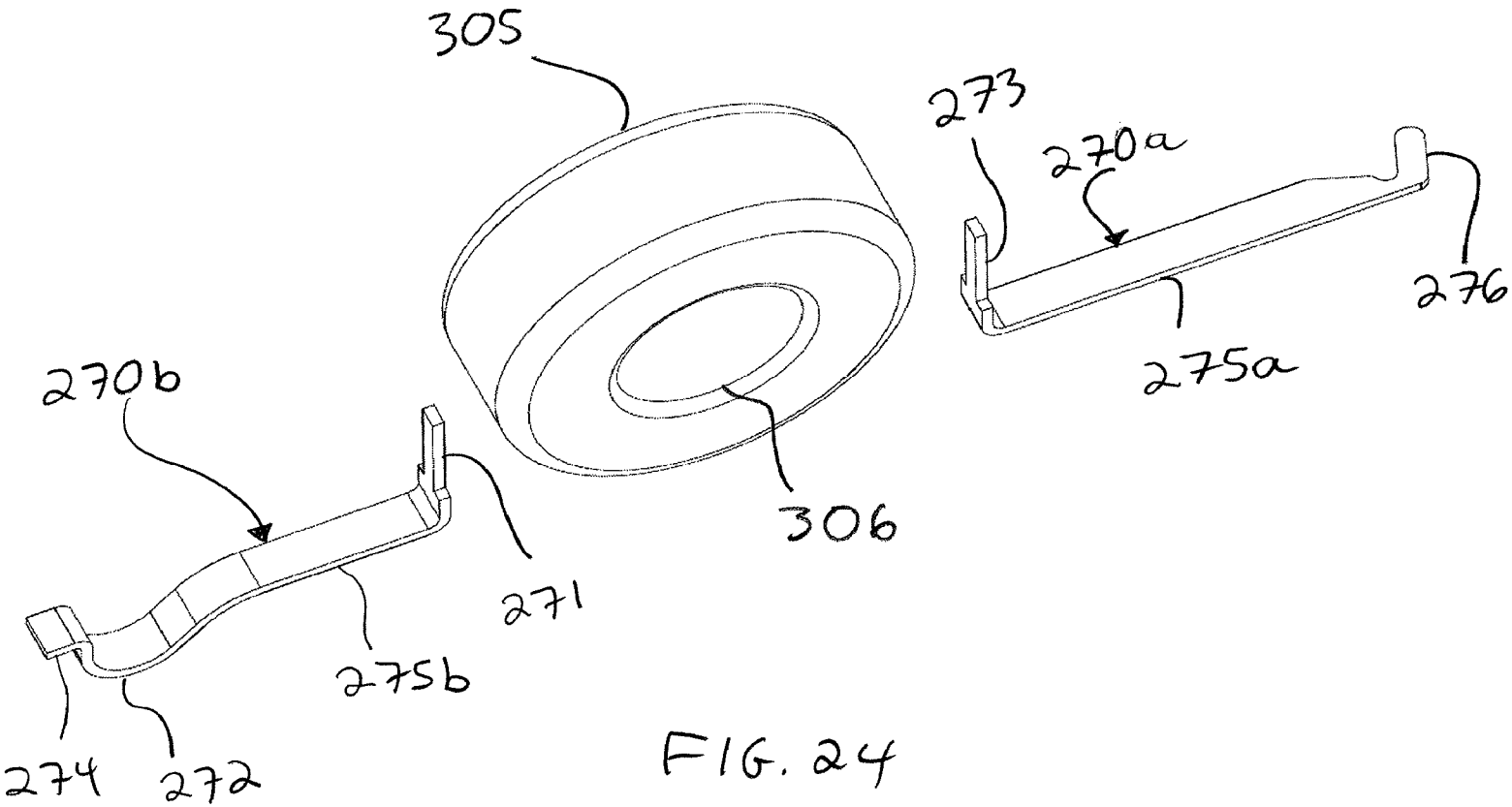
FIG. 24 illustrates a partial perspective view of an embodiment of a terminal and choke.

As can be appreciated from FIG. 24, therefore, an electrical path can exist from a coupling portion 276 to a contact 272. In practice, an insulated conductor (e.g., wire) would wrap around tab 273, pass through choke 305 (which is an example of a magnetic) and then wrap around wire tab 271 to complete the electrical path. The coupling portion 276 can electrically connect to the insulation displacement terminal, thus the choke is in the electrical path between the insulation displacement terminal and the contact.

One issue with the legacy split pair design is that once the different signal pair becomes split, the different coupling is diminished and the split-pair because much more susceptible to noise. The embodiment provided in FIG. 19, however, provides a way to substantially reduce the length of the split so as to preserve the different coupling for as long as possible. In particular, the wires can maintain their different coupling through the wire module by keeping the pairs together. For example, a first pair can be inserted in the first two channels 84, a second pair in the next two channels 84, etc. When the wires are mounted to the insulation displacement portion on the leadframe 100, the pairs (as the wires are side by side) can still remained coupled and can pass through the choke 305 coupled. Once the wires have passed through the choke as coupled pairs, the individual wires can then be routed to the appropriate wire tabs 273. In other words, the split can take place after routing through the magnetics 301, thus minimizing the length of the split and helping to improve the signal to noise ratio.

As depicted, the chokes 305 are not shown with anything holding them in position. In an embodiment, a foam (such as a silicone-based foam) can be used to hold the chokes in position. In another embodiment, the chokes can be potted into position. In another embodiment, ribs such as ribs 330 can be used to hold the chokes in position. Thus, unless otherwise noted, the method of securing the chokes into position is not intended to be limiting.

It should be noted that while a plurality of chokes 305 with a single opening 306 can be used, a dual choke 325 with openings 327 and 328 that extend between face 326*a* and face 326*b* can also be used. The wires 310, 312 aligned with a first pair of terminals wrap around opening 327 and wires aligned with a second pair of terminals wrap around opening 328.

Regardless of the configuration of the latch, the leadframe 300 or the leadframe 100 can be used. Thus, a connector compatible with the RJ-45 receptacle could include magnetics or omit the magnetics, depending on whether the application would benefit from the filtering. Similarly, a connector with the latch side latch release configuration as illustrated in FIGS. 1-15 (which can provide higher density and superior signal performance as there is no need to maintain the legacy design of a split signal pair) can include a leadframe with or without the magnetics 301.

Figure 23A:
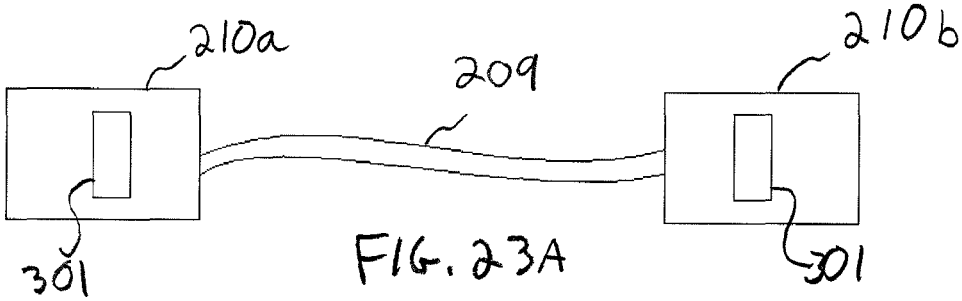
FIG. 23A illustrates a schematic view of an embodiment of a cable assembly.
Figure 23B:
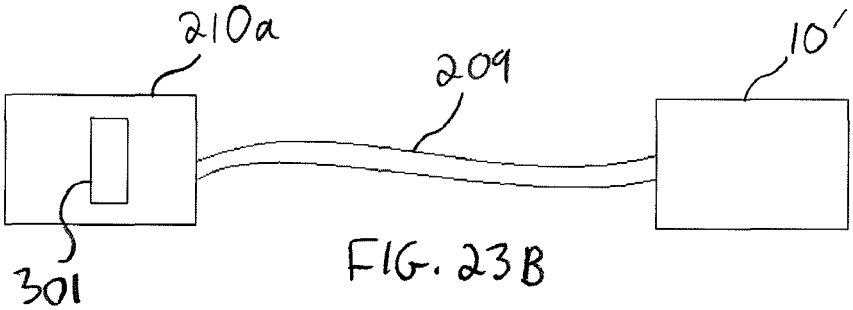
FIG. 23B illustrates a schematic view of another embodiment of a cable assembly.
Figure 23C:
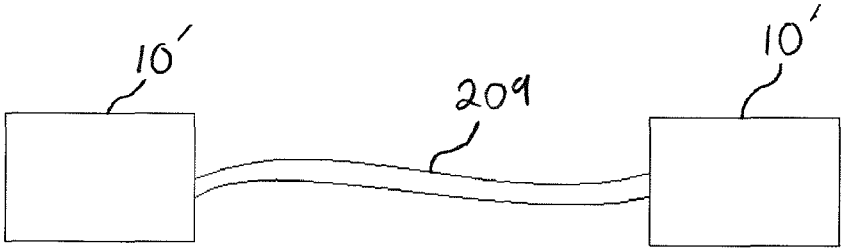

Therefore, as depicted in FIGS. 23A-23C, in an embodiment an assembly can include a cable 209 with two connectors 210*a*, 210*b*, each with magnetics 301. In another embodiment, a cable assembly can include a cable 209 with a connector 10' without the magnetics and a connector 210*a* with magnetics 301. In another embodiment, a cable assembly can include a cable 209 with two connectors 10' that do not include magnetics. As can be further appreciated, each end of the cable can have an alternative form factor. In other words, while both ends could have the same form factor, in an embodiment one end could have the side-latch design of FIGS. 1-15 and the other side could be compatible with RJ-45 connectors.

As can be appreciated from FIGS. 27-29, a number of the features found in the embodiment depicted in FIG. 1 can also be used in a connector 410 depicted in FIGS. 27-29. As above, a crimp tab 426 presses down on the wire module so that fingers 427 can be positioned in slots 86*a* and press on a surface 426*a* of the wire module 480. This can function as noted above and helps insure, in combination with the compressing of the cable (not shown) between the surface 39 and the relief support by legs 422 together to a distance 495, to provide a coupled wire that does not back out of the wire channel. Thus, the distance 496 can be closely aligned to a diameter of the wire so that the gripping finger (which may extend across the entire row of wire channels 84) is able to provide additional strain relief. As can be further appreciated from FIG. 27, a latch release 490 is provided in on base 491 of housing 450 (as noted above). Thus, the depicted designs can allow for variation in construction as discussed herein.

The depicted embodiments have been described in terms of preferred and exemplary embodiments thereof. Numerous other embodiments, modifications and variations within the scope and spirit of the appended claims will occur to persons of ordinary skill in the art from a review of this disclosure.

We claim:

1. A field terminable connector, comprising:

a cage extending around at least three sides of the connector and including a crimp tab configured to be translatable between a first position and a second position;

a wire module with a plurality of wire channels configure to receive a plurality of insulated wires, the wire channels each having an opening that is aligned in a row, the openings facing an exterior of the connector, the wire module translatable from an insert position to a crimped position, wherein in operation the translation of the crimp tab from the first position to the second position causes the wire module to translate to the crimped position;

a leadframe include a plurality of terminal assemblies, each terminal assembly including a terminal with a contact and an insulation displacement portion, wherein the crimp tab, when in the second position, holds the wire module in the crimped position so that the insulation displacement portion extends into the wire channel;

a housing supporting the wire module and the lead frame; and a latch release supported by the housing.

2. The connector of claim 1, further comprising a choke integrated in the connector and positioned in an electrical path between the contact and the insulation displacement portion.

3. The connector of claim 1, where the leadframe further includes a plurality of chokes, each of the plurality of chokes positioned in an electrical path between a corresponding insulation displacement portion and a corresponding contact.

4. The connector of claim 3, wherein the plurality of chokes comprises one of a dual-opening choke and a plurality of single opening chokes.

5. The connector of claim 1, wherein the latch release is coupled to a pull tab that includes an elastic body, the elastic body configured to bias the latch release toward an initial position.

6. The connector of claim 1, wherein the terminals each extends from the contact to the insulation displacement portion in a continuous manner.

7. A plug connector, comprising:

a cage with a least one crimp tab;

a housing supporting the cage;

a wire module position supported by the housing, the wire module including a plurality of wire channels each configured to receive a wires, the wire channels having a staggered arrangement and each of the channels having an opening aligned in a row, the openings exposed to an exterior of the plug connector along a side of the connector; and a leadframe positioned at least partially in the cage, the leadframe including a plurality of terminal assemblies, each terminal assembly including a contact portion and an insulation displacement portion electrically coupled together, wherein the crimp tab holds the wire module and the leadframe in a crimped position so that the insulation displacement portion extends into the wire channel.

8. The plug connector of claim 7, wherein the cage includes opposing crimp tabs.

9. The plug connector of claim 7, wherein the housing includes a latch release with a lever configured to actuate the latch release.

10. A connector, comprising:

a leadframe that includes a plurality of insulation displacement terminals aligned in a first and second row and a plurality of contacts in a third row, the plurality of contact each electrically coupled to one of the plurality of insulation displacement terminals;

a wire module supported by the cage, the wire module include a plurality of wire channels, each of the plurality of wire channel aligned with one of the plurality of insulation displacement terminals;

a housing configured to support the leadframe and the wire module; and a cage with a crimp tab, the cage positioned at least partially around the housing such that the crimp tab is exposed to an exterior of the connector, the wire module configured to translate from a first position to a second position in response to translation of the crimp tab.

11. The connector of claim 10, wherein each of the plurality of insulation displacement terminals are configured to be at least partially positioned in the corresponding wire channel when the crimp tab, in operation, is translated from a first position to a second position.

12. The connector of claim 11, wherein each of the plurality of contacts is provided on a first terminal that is distinct from but electrically connected to the corresponding insulation displacement terminal.

13. The connector of claim 12, wherein the insulation displacement terminals are arranged in a first and second row in an alternating pattern.

14. The connector of claim 13, wherein the leadframe further comprises a plurality of chokes, the chokes in an electrical path that extends between the insulation displacement terminals and the contact portions.

15. The connector of claim 14, wherein the connector further comprises an actuation member and a latch release, the actuation member coupled to the latch release.

16. The connector of claim 15, wherein the cage extends along a top side, a bottom side and two side sides of the housing.

* * * * *